US010541124B2

(12) United States Patent
Baba

(10) Patent No.: US 10,541,124 B2
(45) Date of Patent: Jan. 21, 2020

(54) ION INJECTION METHOD INTO SIDE-ON FT-ICR MASS SPECTROMETERS

(71) Applicant: DH Technologies Development Pte. Ltd., Singapore (SG)

(72) Inventor: Takashi Baba, Richmond Hill (CA)

(73) Assignee: DH Technologies Development Pte. Ltd. (SG)

( * ) Notice: Subject to any disclaimer, the term of this patent is extended or adjusted under 35 U.S.C. 154(b) by 0 days.

(21) Appl. No.: 16/069,506

(22) PCT Filed: Jan. 10, 2017

(86) PCT No.: PCT/IB2017/050107
§ 371 (c)(1),
(2) Date: Jul. 11, 2018

(87) PCT Pub. No.: WO2017/130070
PCT Pub. Date: Aug. 3, 2017

(65) Prior Publication Data

US 2019/0051506 A1 Feb. 14, 2019

Related U.S. Application Data

(60) Provisional application No. 62/287,859, filed on Jan. 27, 2016.

(51) Int. Cl.
*H01J 49/38* (2006.01)
*H01J 49/42* (2006.01)
*H01J 49/10* (2006.01)

(52) U.S. Cl.
CPC ..... *H01J 49/38* (2013.01); *H01J 49/102* (2013.01); *H01J 49/422* (2013.01); *H01J 49/426* (2013.01)

(58) Field of Classification Search
CPC ..... H01J 49/38; H01J 49/102; H01J 49/422; H01J 49/426; H01J 49/4235
See application file for complete search history.

(56) References Cited

U.S. PATENT DOCUMENTS 4,931,640 A 6/1990 Marshall et al.
5,019,706 A * 5/1991 Allemann ..... G01R 33/64 250/282

(Continued)

FOREIGN PATENT DOCUMENTS

WO 2015189539 A1 12/2015

OTHER PUBLICATIONS

International Search Report and Written Opinion for PCT/IB2017/050107 dated Apr. 11, 2017.

*Primary Examiner* — Brooke Purinton
(74) *Attorney, Agent, or Firm* — John R. Kasha; Kelly L. Kasha; Kasha Law LLC

(57) ABSTRACT

Improvements to a side-on Penning trap include methods to stabilize ions in the trap. The ions are stabilized by injecting ions in the focusing region of the non-uniform DC fields produced by the pad electrodes of the trap. Ions are injected along an injection axis shifted from the central axis of a gap between a positively biased electrode pad and negatively biased electrode pad of the trap. Improvements also include methods to compensate for the Lorentz force that is produced when ions are injected into a side-on Penning trap. Electrodes of an ion injection device are DC biased so that the electrodes produce an electric field along the axis of the device that compensates for the Lorentz force. Finally, methods are provided to increase the m/z range of ions injected into a side-on Penning trap by pre-trapping ions just before injection of the ions into the trap.

17 Claims, 26 Drawing Sheets

(56) References Cited

U.S. PATENT DOCUMENTS

| | | | | |
|---|---|---|---|---|
| 7,579,589 | B2 * | 8/2009 | Miller | G01N 27/624 250/281 |
| 2002/0079444 | A1 | 6/2002 | Senko | |
| 2009/0218485 | A1 * | 9/2009 | Kaiser | H01J 49/38 250/283 |
| 2011/0251801 | A1 * | 10/2011 | Misharin | H01J 49/0036 702/32 |
| 2012/0280123 | A1 * | 11/2012 | Kenny | H01J 49/422 250/290 |
| 2014/0299761 | A1 | 10/2014 | Giles et al. | |
| 2015/0357176 | A1 | 12/2015 | Sano | |
| 2017/0345637 | A1 * | 11/2017 | Green | H01J 49/4265 |
| 2017/0358437 | A1 * | 12/2017 | Baba | H01J 49/38 |

* cited by examiner

400

500

600

1800

2100

2300

2500

2600

ION INJECTION METHOD INTO SIDE-ON FT-ICR MASS SPECTROMETERS

CROSS REFERENCE TO RELATED APPLICATION

This application claims the benefit of U.S. Provisional Patent Application Ser. No. 62/287,859, filed Jan. 27, 2016, the content of which is incorporated by reference herein in its entirety.

INTRODUCTION

The teachings herein relate to magnetic ion traps, and more particularly, to methods and systems for improving the performance of a side-on injection Penning trap. One performance improvement involves shifting the axis of ion injection relative to the trap electrodes to increase ion stability in the trap. Another improvement involves applying a compensating electric field outside of the trap to the continuous flow ions just before they enter the trap to counteract the Lorentz force produced by the changing magnetic field at the edge of the trap. Another improvement involves pre-trapping ions and injecting them pulse-wise to increase the mass-to-charge ratio (m/z) than can be analyzed in the trap.

BACKGROUND

Mass spectrometry (MS) is an analytical technique that allows the determination of the m/z of ions of sample molecules. Generally, mass spectrometry involves ionizing sample molecule(s) and analyzing the ions in a mass analyzer. One exemplary MS technique known in the art is Fourier transform ion cyclotron resonance (FT-ICR) mass spectrometry. FT-ICR mass spectrometry has received considerable attention for its ability to make accurate, high resolution mass measurements.

FIG. 1 demonstrates the general structure of one FT-ICR mass spectrometer system 100 known in the art. FT-ICR mass spectrometer system 100 includes an ion source 110, a first mass analyzer 120, and an FT-ICR unit 140. In operation, the first mass analyzer 120 (e.g., linear quadrupole electrodes 122 to which RF and/or DC voltages can be applied) receives ions from the ion source 110 and filters those ions (e.g., selectively transmits ions of a selected m/z range) to the downstream elements to be further analyzed.

In known systems, the FT-ICR unit 140 generally comprises a magnetic ion trap (e.g., a Penning trap) having a ring electrode 142 and two end-cap electrodes 144*a,b*. A Penning trap is a device used to store charged particles. A Penning trap generally stores charged particles using a homogeneous magnetic field and an inhomogeneous quadrupole electric field. The end-cap electrodes 144*a,b* include orifices 146 disposed on the central, longitudinal axis (A) of the MS system 100 through which ions are received from the ion source 110/first mass analyzer 140 and through which the ions are transmitted to downstream elements (e.g., mass analyzer 160), respectively. In order to trap the charged particles, FT-ICR units like that shown in FIG. 1 generally utilize a static electric field generated between the end-cap electrodes 144*a,b* (typically maintained at a DC voltage of the same polarity as the ions to be trapped) and the ring electrode 142 (typically maintained at a DC voltage of the opposite polarity as the ions to be trapped) to confine the ions axially (i.e., in the z-direction along the central axis (A) between the orifices 146 of the end-cap electrodes 144*a,b*).

Additionally, a static, uniform magnetic field (B, typically not less than 1 T) is applied along the direction in which ions are injected (i.e., along the central axis (A)) so as to confine the charged particles radially (i.e., in the x- and y-directions, perpendicular to the axis of the magnetic field).

Because the resolution capability of FT-ICR is generally related to the uniformity and intensity of the magnetic field to which the ions are subjected (e.g., certain performance features vary as a function of the square of the intensity of the magnetic field such that a minimum value of about 1 T is recommended in high performance MS applications), magnetic ion traps for FT-ICR have traditionally utilized strong electromagnets or super-conducting electromagnets (e.g., solenoid 148, within which the ring electrode 142 and end-cap electrodes 144*a,b* are housed) to produce the high-intensity magnetic fields (e.g., at least 1 T, sometimes as high as 7-15 Tesla) along the central axis (A), as schematically depicted in FIG. 1 by the arrow indicating the direction of the magnetic field (B). Such electromagnets, however, can be extremely expensive and cumbersome (e.g., heavy, bulky), and require complex power supplies and/or cooling installations for operation. The high cost and limited mobility of FT-ICR systems resulting from the size of the magnets (electromagnets or permanent) has heretofore limited the adoption of FT-ICR despite the technique's potential benefits (e.g., high accuracy and resolution).

U.S. Provisional Application No. 62/085,459 (hereinafter the "'459 Application"), entitled "Fourier Transform Ion Cyclotron Resonance Mass Spectrometry, is directed to a new FT-ICR system or mass spectrometer. This new system uses a new side-on injection Penning trap. This trap uses smaller, less expensive permanent magnets (as well as electromagnets) to reduce the cost, size, and/or complexity of the trap relative to conventional Penning traps. This trap also uses electrodes printed on printed circuit boards (PCBs) to reduce the cost, size, and/or complexity of the trap.

This new side-on injection Penning trap enables Fourier transform ion cyclotron resonance mass spectrometry to be performed in a relatively narrow gap and allows ions to be injected into the trap in a direction substantially perpendicular to the magnetic fields applied to the gap. As a result, smaller, less expensive magnets can be used to produce the high-intensity, uniform magnetic fields utilized in high performance FT-ICR/MS applications.

FIG. 2 is an exemplary schematic diagram of a side-on injection FT-ICR system 200. Side-on injection FT-ICR system 200 includes an ion source 210 for generating ions from a sample of interest, an ion guide 220 for focusing and/or filtering the ions to be transmitted thereby, a side-on injection Penning trap 240, and a downstream mass analyzer 260 (as an option). The exemplary side-on injection Penning trap 240 includes a plurality of electrodes 242, 244 for generating an electric field within the side-on injection Penning trap 240 and at least one magnet 248 for generating a magnetic field between the electrodes 242, 244 such that the ions can be trapped via the combination of the effects thereon of the electric and magnetic fields.

In various aspects, ions generated by the ion source 210 can be injected into the side-on injection Penning trap 240 substantially along the central axis (A). After being transmitted into the side-on injection Penning trap 240 and into the space bounded by the electrodes 242, 244 disposed on opposed sides of the central axis (A), the ions are subjected to the magnetic and electric fields generated therein via the magnet(s) 248 and the electrodes 242, 244. As schematically depicted in FIG. 2, for example, the magnet(s) 248 can be configured to generate a magnetic field (B) within the side-on injection Penning trap 240 having a magnetic field axis that is substantially perpendicular to the injection axis/central axis (A).

The at least one magnet 248 can have a variety of configurations for generating a magnetic field within the side-on injection Penning trap 240. By way of non-limiting example, the at least one magnet 248 can be one or more permanent magnets (i.e., an object made from magnetized material that creates its own magnetic field) or an electromagnet (e.g., a solenoid that generates a magnetic field when an electric current flows therethrough) that are configured to generate a uniform, high-intensity magnetic field within the gap between the electrodes 242, 244 in a direction substantially perpendicular to the injection axis. The electrodes 242, 244 can also have a variety of configurations such that various electric potentials can be applied thereto so as to change the electric field within the side-on injection Penning trap 240, thereby altering the amplitude of ions' cyclotron motion and/or the trajectory of the ions' drift.

FIG. 3 is an exemplary schematic diagram of an electrode 242 of the side-on injection FT-ICR system 200 of FIG. 2. An exemplary SIMION simulation is depicted in FIG. 3, demonstrating the path 310 of a cation (positive ion) during its injection from the ion guide 220 of FIG. 2 into the magnetic trap 240 of FIG. 2, during which the depicted exemplary potentials of FIG. 3 are applied to the electrodes 242*a-e* of FIG. 3 (SIMION is an ion motion simulator in vacuum provided by Scientific Instrument Service, Inc. NJ). The electrodes 242*a-e* are formed on a PCB, for example.

As indicated by arrow 320 of Figure, the cation is injected into the gap between the electrodes 242, 244 of FIG. 2 substantially along the central axis of the ion guide 220. Upon entering the side-on injection Penning trap 240 of FIG. 2, the ion is subject to the electric field generated by the electrodes 242, 244 of FIG. 2 and the uniform magnetic field generated in the gap between the electrodes. As demonstrated schematically and understood by a person skilled in the art, the cation would tend to move along an equipotential line of superimposed electrical potential gradient within the uniform magnetic field generated by the magnets 248 of FIG. 2, with the cation's cyclotron motion overlapping on the transverse motion (drift).

Accordingly, upon entering the side-on injection Penning trap 240 of FIG. 2, the cation proceeds initially along the non-conducting portion between the upper arch electrodes 242*d,b* of FIG. 3 (−1V) and the lower arch electrodes 242*e,c* of FIG. 3 (+1V). At the intersection of the upper, inner arch electrode 242*b* (−1V), the lower, inner arch electrode 242*c* (+1V), and the center electrode 242*a* (−1V), however, the ion is deflected from its initial axis along equipotential lines around the center electrode 242*a* (−1V) and the lower, inner arch electrode 242*c* (+1V). As such, the cation travels substantially along the non-conductive portion between the center electrode 242*a* (−1V) and the lower, inner arch electrode 242*c* (+1V). At the intersection of the lower, inner arch electrode 242*c* (+1V), the center electrode 242*a* (−1V), and the upper, inner arch electrode 242*b* (−1V), the cation is again deflected along the non-conductive portion extending between the lower, inner arch electrode 242*c* (+1V) and the upper, inner arch electrode (−1V), and is ejected along the non-conductive portion on the left side of FIG. 3. As such, under the exemplary conditions depicted in FIG. 3, the cation can be transmitted through the magnetic ion trap (e.g., into downstream mass analyzer of FIG. 2), the ejection from the magnetic ion trap again occurring substantially along the central axis (A) of FIG. 2. It should be appreciated that the arrangement of the electrodes 242*a-e* and the potentials applied thereto in FIG. 3 are merely exemplary, and can be modified in order to otherwise control the motion of the ions. By way of example, if the polarity of the electrodes 242*a-e* of FIG. 3 were reversed, it would be appreciated that an anion (negative) injected into this modified trap would exhibit substantially the same path through the magnetic ion trap as that depicted for the cation in FIG. 3. Line F-F' shows the location of cross-section shown in FIG. 4.

Ion Instability

Ions have a drift motion when they are in a DC potential gradient (electric field) coupled with a uniform magnetic field as shown in FIG. 2. In a general model to discuss this drift motion, the DC potential gradient is often uniform, ($\Phi$=const*x or (Ex=−const, Ey=0, Ex=0), for example. In the Penning trap of FIG. 2, however, because the DC field is produced using two PCBs facing each other with a narrow gap, the DC field is not uniform.

FIG. 4 is a cross-sectional side view 400 of the electrodes of FIG. 2. The location of the cross-section with respect to electrode 242 of FIG. 3 is shown in FIG. 3 as line F-F'. FIG. 4 shows that the DC field between the electrodes of FIG. 2 is not uniform. This non-uniform potential makes a focusing region and a defocusing region based on the direction of the magnetic field. For positively charge ions, the positively biased pad side is focusing, and the negatively biased pat side is defocusing. Arrows 410 show that the negatively biased electrodes are defocusing for positive ions and arrows 420 show that the positively biased electrodes are focusing for positive ions.

As described above, ions are injected to follow the non-conducting portions or paths of the electrodes 242 and 244 of FIG. 2. For example, as shown in FIG. 3 ions are injected at location 320 along an axis to follow the non-conducting path between electrodes 242*d* and 242*e*. However, as FIG. 4 shows these non-conducting paths between positively and negatively biased electrodes produce non-uniform DC fields in the gaps between electrodes. These non-uniform fields, in turn, produce focusing and defocusing regions.

As a result, if ions are directed along the non-conducting paths between positively and negatively biased electrodes, at least a portion of the ions are in the defocusing region. Ions in the defocusing region become unstable and are lost from the trap. For example, FIG. 4 shows that positive ions following the non-conducting portion between pads 242*a* and 242*c* and between pads 244*a* and 244*c* that are closer to the negatively biased pads 242*a* and 244*a* feel the force shown by arrows 410 and are defocused away from the center of the gap and lost from the trap. In contrast, positive ions following the non-conducting portion between pads 242*a* and 242*c* and between pads 244*a* and 244*c* that are closer to the positively biased pads 242*c* and 244*c* feel the force shown by arrows 420 and are focused to the center of the gap and stabilized in the trap.

The at least partial ion instability produced by non-uniform DC fields in the gap of the trap results in a reduced ion efficiency of the trap (or reduced number of ions in the trap). As a result, systems and methods are needed to inject ions into the trap so that the ions are maintained in the focusing region of the non-uniform DC fields produced by the pad electrodes of the side-on Penning trap. In other words, if an ion is traveling in the focusing area, the ion should have an efficient transmission, but if an ion is traveling in the defocusing area, the ion can be lost during injection. The issue then is how to control the ion trajectory to keep them in the focusing region.

Lorentz Force at the Entrance of the Trap in Continuous Flow

FIG. 5 is an exemplary plot 500 showing how the magnetic field varies across a side-on Penning trap. FIG. 5 shows that the magnetic field within the trap is constant or uniform. However, outside of the trap, the magnetic field quickly decreases in intensity. Therefore, FIG. 5 shows that ions entering the trap experience a sharply increasing magnetic field as they move toward the trap.

The Lorentz force is a force that a moving charged particle experiences as a result of the combined effects of an electric field and a magnetic field. The Lorentz force, F, is expressed as $F=q[E+(v\times B)]$, where q is the charge of the charged particle, E is the electric field experienced by the charged particle, v is the velocity of the charged particle, and B is the magnetic field experienced by the charged particle.

The increasing magnetic field that ions experience as they are injected into a side-on Penning trap with a certain velocity produces a Lorentz force. This Lorentz force can cause the ions to be deflected away from the trap, preventing ion injection. As a result, systems and methods are needed to compensate for the Lorentz force that is produced when ions are injected into a side-on Penning trap.

Large m/z Range

In a side-on Penning trap, long term ion accumulation or trapping is accomplished by capturing ions in pulses or pulse-wise. There are, therefore, two modes of operation. There is an injection mode and a trapping mode. During the injection mode, injected ions are located in the arc of a trapping orbit. FIG. 3, for example, shows the injected ions in the arc of a trapping orbit during the injection mode. In the trapping mode, the DC voltages applied to the electrodes are switched to trap the ions in a complete circle between the electrodes.

The duration of the injection mode is dependent on the strength of magnetic field and the DC bias of electrodes. The duration is, for example, 10-50 micro seconds. Another way of expressing the duration is as a drift frequency. The drift frequency is typically given by $V/(2Bd^2)$. V is a bias difference between the center circle and the first ring, B is the magnetic field intensity, and d is the distance between two PCB plates. This frequency is an analog of the magnetron motion frequency in a conventional FT-ICR cell.

An important feature of the side-on Penning trap, therefore, is that the trapping duration or drift frequency is not dependent on an injected ion's m/z values and injection kinetic energy. The only dependence on m/z value or injection kinetic energy is in the cyclotron motion. This is the spiral or circular motion of the ions. In other words, the path shape of ions in a side-on FT-ICR system is dependent on m/z value and injection kinetic energy, but the path length of the ions is not dependent on m/z value or injection kinetic energy.

The fact that the path length of the ions is not dependent on m/z value or injection kinetic energy means that a side-on FT-ICR system can potentially analyze a collection of ions with a large range of m/z values at the same time. The primary problem is getting the ions with a large range of m/z values into the side-on Penning trap. For example, if ions with a large range of m/z values are injected from a continuous flow device, the continuous flow device will separate the ions by m/z value before they reach the side-on Penning trap. As a result, systems and methods are needed to inject a collection of ions with a large range of m/z values into the side-on Penning trap at the same time.

SUMMARY

Various embodiments include a system and method to stabilize charged particles in a side-on injection Penning trap. The charged particles are stabilized by injecting charged particles substantially in the focusing region of the non-uniform DC fields produced by the pad electrodes of the trap. More specifically, charged particles are injected along an injection axis shifted from the central axis of a gap between a positively biased electrode pad and negatively biased electrode pad of the trap. The injection axis can be shifted by mechanically shifting the charged particle injection device or by biasing the charged particle injection device to electrically shift the injection axis.

The charged particle injection device can include a solid rod RF quadrupole ion guide. The RF quadrupole ion guide is mechanically shifted to shift the injection axis of the charged particles.

The charged particle injection device can include two sets of three trapezoidal electrodes printed on the same two PCBs as the electrodes of the side-on injection Penning trap. The injection axis of the charged particles is shifted by printing the two sets of three trapezoidal electrodes mechanically shifted with respect to the electrodes of the side-on injection Penning trap.

The charged particle injection device can include two sets of four trapezoidal electrodes printed on the same two PCBs as the electrodes of the side-on injection Penning trap. The injection axis of the charged particles is shifted by applying a voltage across the two central electrodes of each of the two sets of four trapezoidal electrodes. The injection axis of the charged particles is, therefore, shifted without mechanically shifting the two sets of four trapezoidal electrodes with respect to the electrodes of the side-on injection Penning trap.

Various embodiments include a system and method to compensate for the Lorentz force that is produced when charged particles are injected into a side-on injection Penning trap. Electrodes of a charged particle injection device of a side-on injection Penning trap are DC biased so that the electrodes produce an electric field along the axis of the charged particle injection device that compensates for the Lorentz force. The electric field is a dipolar electric field that increases proportionally with the increase in the magnetic field along the path of charged particles in the charged particle injection device. Tapered RF quadrupole electrode pads printed on the PCBs of the side-on injection Penning trap are used to produce the dipolar electric field.

The charged particle injection device can include two sets of three trapezoidal electrodes printed on the PCBs of the side-on injection Penning trap. A DC voltage is applied between the two outer trapezoidal electrodes of the two sets of three trapezoidal electrodes to produce the dipolar electric field.

The charged particle injection device can also include two sets of four trapezoidal electrodes printed on the PCBs of the side-on injection Penning trap. A DC voltage is applied between the two inner trapezoidal electrodes of the two sets of four trapezoidal electrodes to produce the dipolar electric field.

Various embodiments include a system and method to increase the m/z range of ions injected into a side-on injection Penning trap by pre-trapping ions just before injection of the ions into the side-on injection Penning trap. A pre-trap device is used to collect ions across a wide mass-to-charge ratio (m/z) range and inject the collected ions at the same time into the Penning trap in order to increase the m/z range of the ions that is analyzed.

The pre-trap device can include a solid rod RF quadrupole linear ion trap. The pre-trap device can include two sets of three trapezoidal electrodes printed on the same two PCBs as the electrodes of the side-on injection Penning trap. The pre-trap device can include two sets of four trapezoidal electrodes printed on the same two PCBs as the electrodes of the side-on injection Penning trap.

BRIEF DESCRIPTION OF THE DRAWINGS

The skilled artisan will understand that the drawings, described below, are for illustration purposes only. The drawings are not intended to limit the scope of the present teachings in any way.

Figure 1:
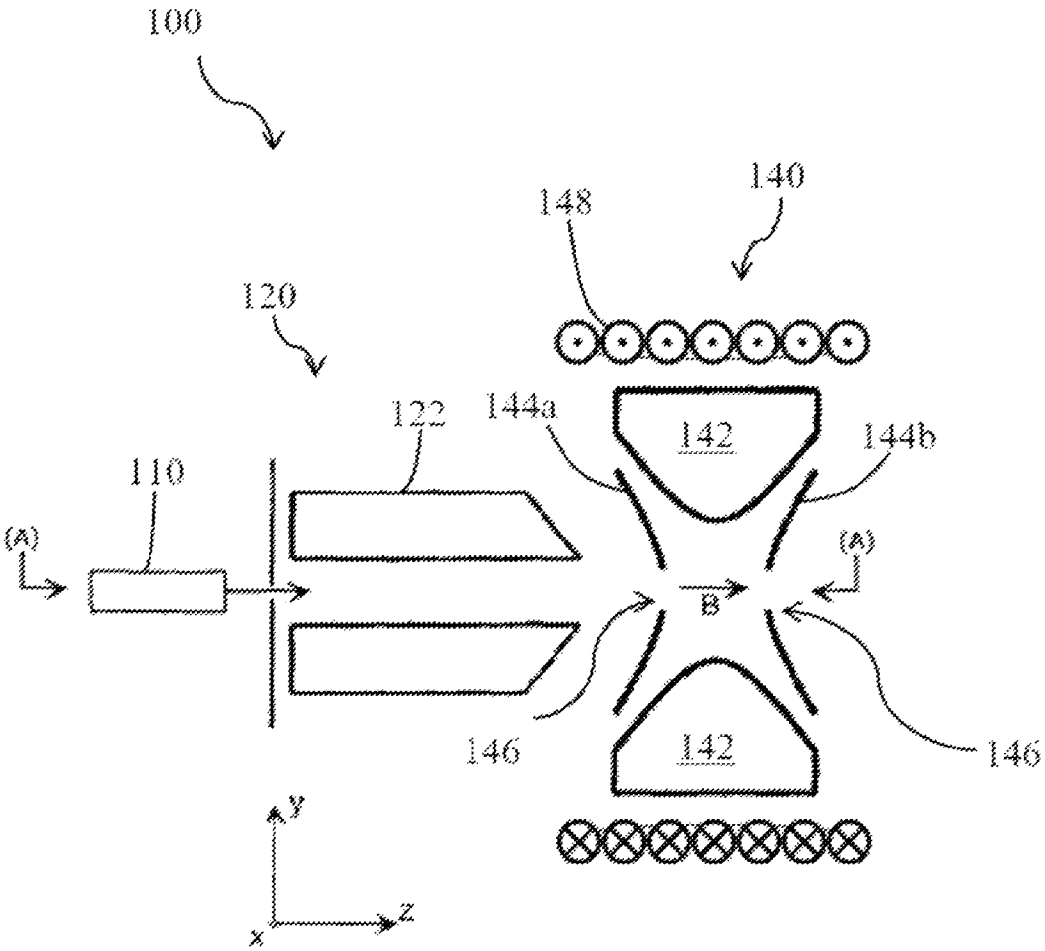
FIG. 1 (PRIOR ART)
FIG. 1 demonstrates the general structure of one FT-ICR mass spectrometer system known in the art.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

Figure 6:
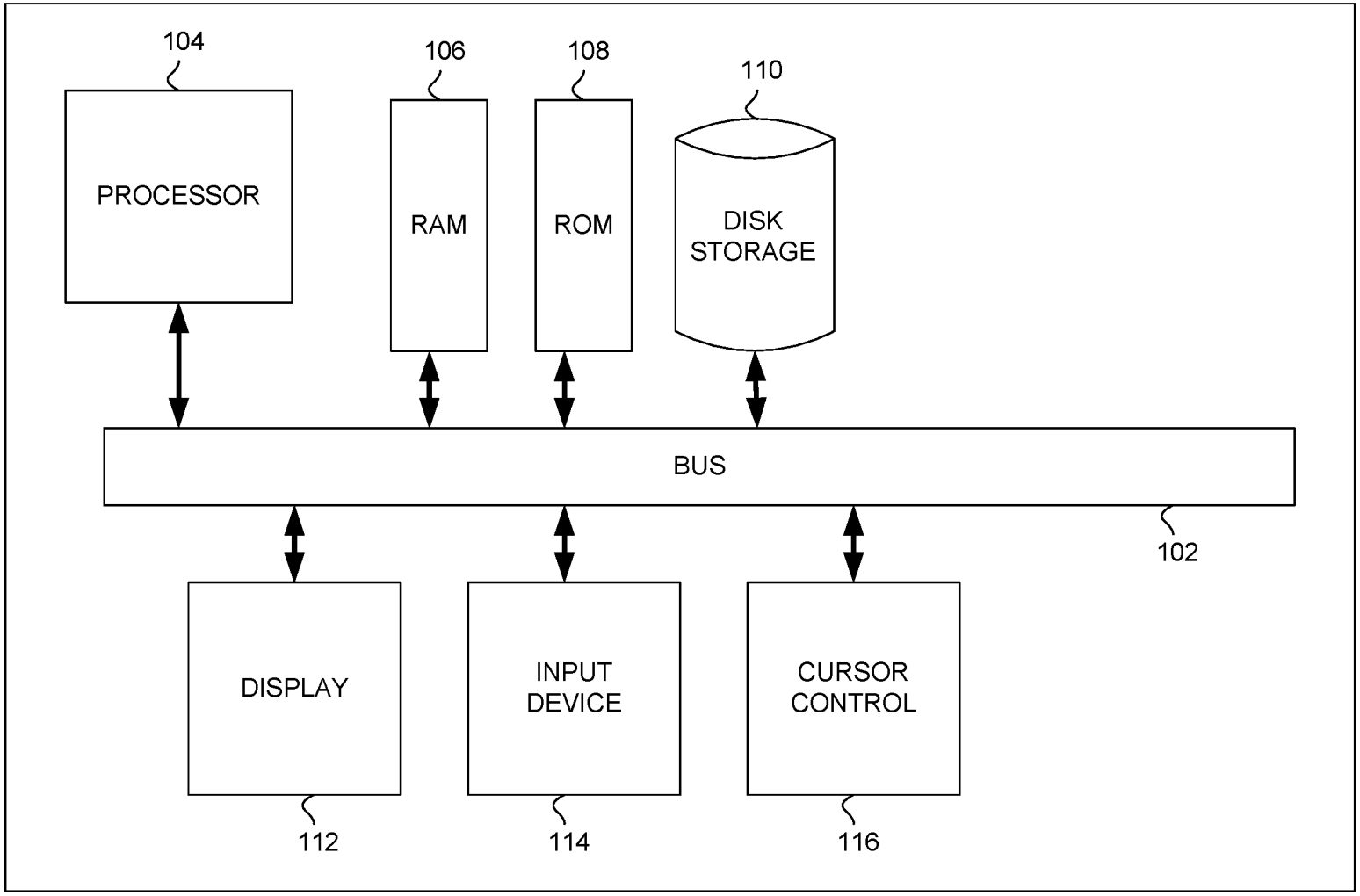
FIG. 6 is a block diagram that illustrates a computer system, upon which embodiments of the present teachings may be implemented.

FIG. 6 is a block diagram that illustrates a computer system 600, upon which embodiments of the present teachings may be implemented. Computer system 600 includes a bus 102 or other communication mechanism for communicating information, and a processor 104 coupled with bus 102 for processing information. Computer system 600 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 600 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 600 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

Computer system 600 can perform the present teachings. Consistent with certain implementations of the present teachings, results are provided by computer system 600 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 600 can be connected to one or more other computer systems, like computer system 600, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 600 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Side-on Injection Penning Trap Improvements

Figure 2:
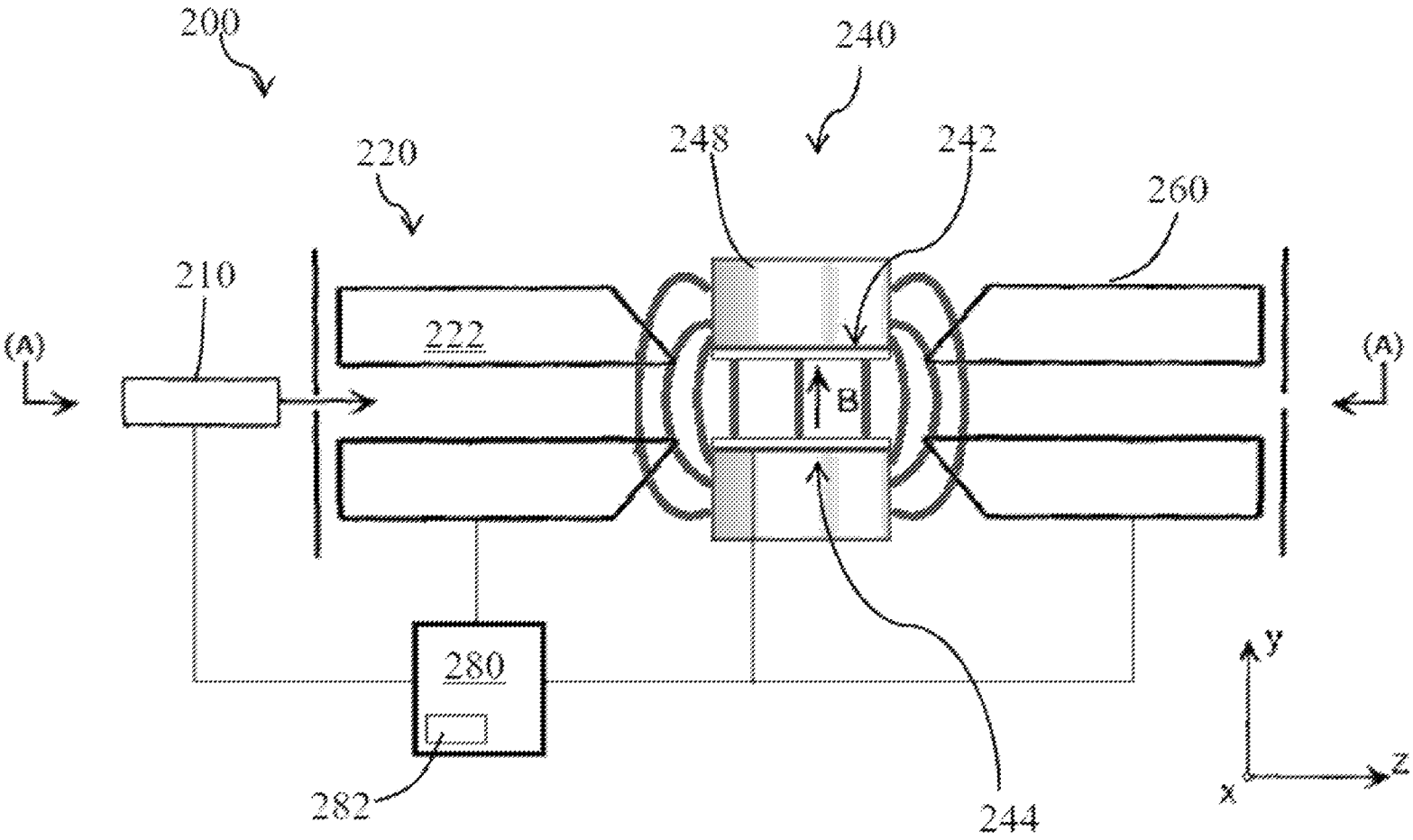
FIG. 2 (PRIOR ART)
FIG. 2 is an exemplary schematic diagram of a side-on injection FT-ICR system.

FIG. 2 depicts a side-on injection FT-ICR system as described by the '459 Application, which is incorporated herein by reference in its entirety. This new side-on injection FT-ICR system includes a new side-on Penning trap that uses smaller, less expensive permanent magnets (as well as electromagnets) and PCB electrodes to reduce the cost, size, and/or complexity of the system relative to conventional Penning traps. This side-on injection Penning trap enables Fourier transform ion cyclotron resonance mass spectrometry across relatively narrow gap magnetic fields substantially perpendicular to the axis along which the ions are injected into the ion trap.

Ion Stability

Figure 4:
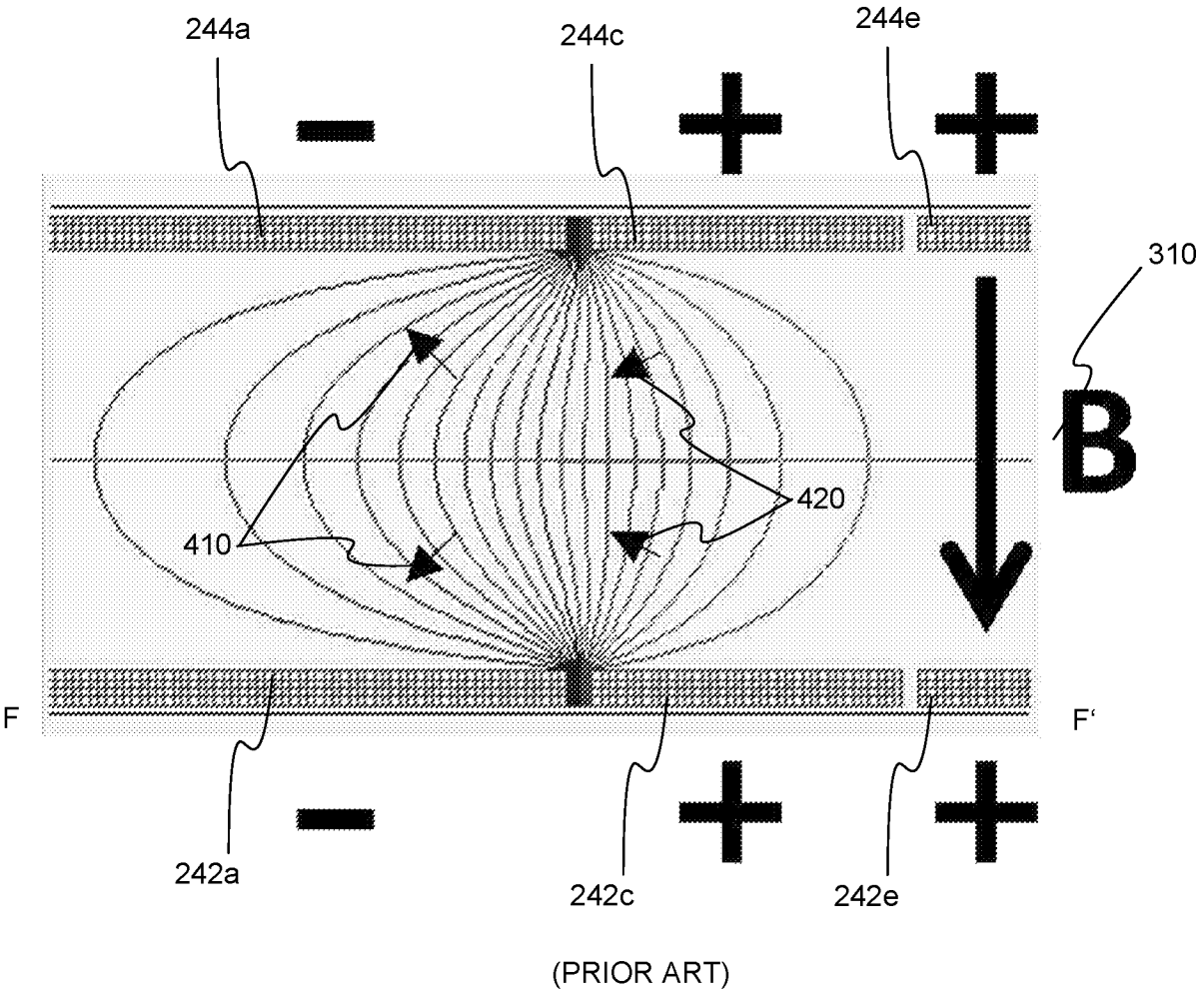
(PRIOR ART) FIG. 4
FIG. 4 is a cross-sectional side view of the electrodes of FIG. 2.

As described above, ions have a drift motion when they are in a DC potential gradient (electric field) coupled with a uniform magnetic field as shown in FIG. 2. In the side-on Penning trap of FIG. 2, however, because the DC field is produced using two PCBs facing each other with a narrow gap, the DC field is not uniform. FIG. 4 shows that the DC field between the electrodes of FIG. 2 is not uniform. This non-uniform potential makes a focusing region and a defocusing region based on the direction of the magnetic field.

The at least partial ion instability produced by non-uniform DC fields in the gap of a side-on Penning trap results in a reduced ion efficiency of the trap (or reduced number of ions in the trap). As a result, systems and methods are needed to inject ions into the trap so that the ions are maintained in the focusing region of the non-uniform DC fields produced by the pad electrodes of the trap.

In various embodiments, ion stability in a side-on Penning trap is improved by injecting ions in the focusing region of the non-uniform DC fields produced by the pad electrodes of the trap. More specifically, ions are injected along an injection axis shifted from the central axis of a gap between a positively biased electrode pad and negatively biased electrode pad of the trap.

Figure 7:
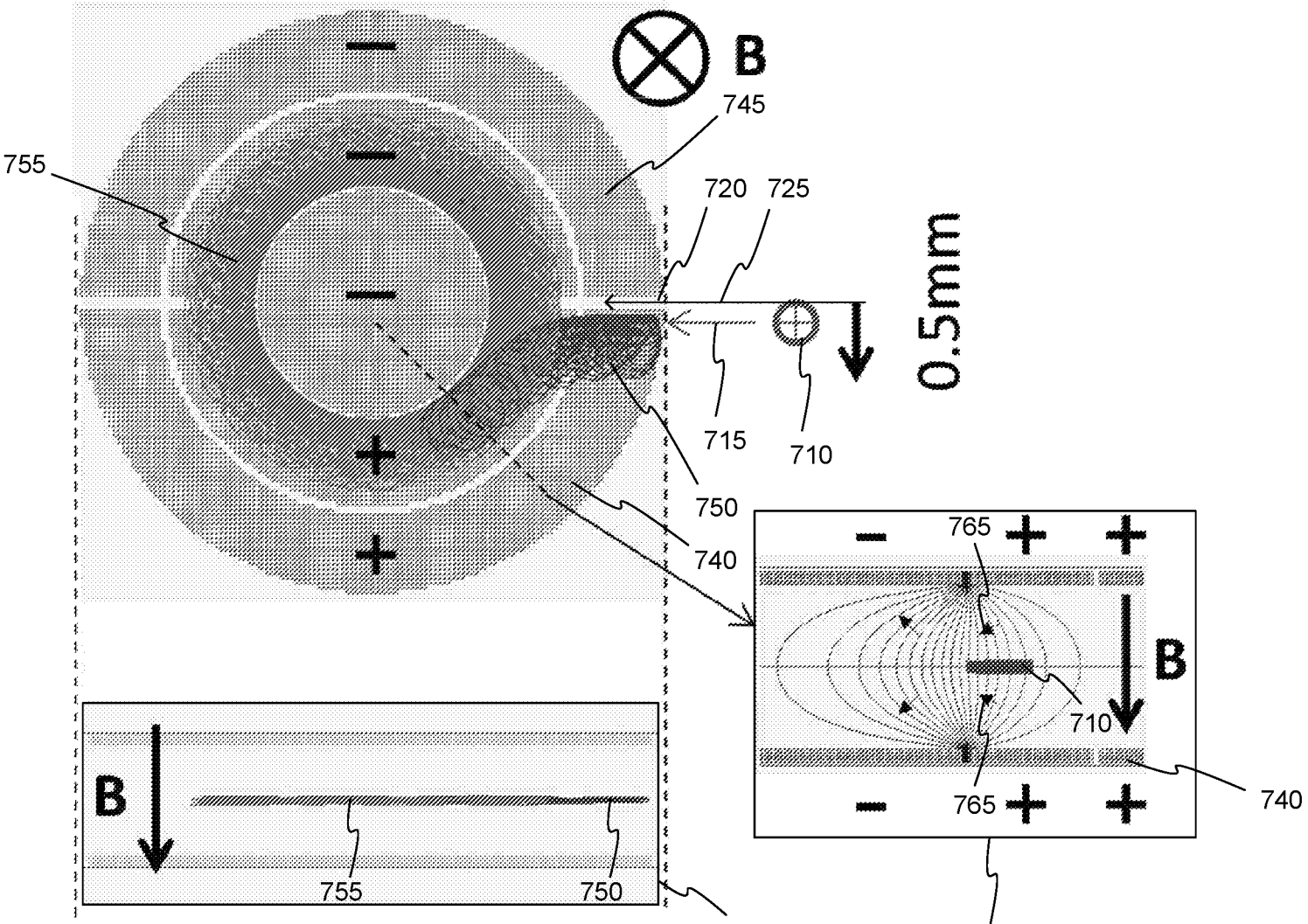
FIG. 7 is a top view of an electrode of a side-on Penning trap showing positive ions that are injected along an injection axis shifted from the central axis of a gap between a positively biased electrode pad and negatively biased electrode pad towards the positively biased electrode pad, in accordance with various embodiments.

FIG. 7 is a top view 700 of an electrode of a side-on Penning trap showing positive ions that are injected along an injection axis shifted from the central axis of a gap between a positively biased electrode pad and negatively biased electrode pad towards the positively biased electrode pad, in accordance with various embodiments. In FIG. 7, positive ions (or cations) 710 are injected into a side-on Penning trap along injection axis 715. Injection axis 715 is shifted from central axis 725 of gap 720 toward positively biased electrode pad 740. It is shifted 0.5 mm, for example. Gap 720 is the gap between positively biased electrode pad 740 and negatively biased electrode pad 745.

As described above, a side-on Penning trap generally operates in two modes: an injection mode and trapping mode. The polarity of the voltages on certain pads of the electrodes change between modes. The polarities shown in FIG. 7 are for the injection mode. However, FIG. 7 shows the paths of positive ions for both the injection mode and the trapping mode. Path 750 is the path of positive ions in injection mode, and path 755 is the path of positive ions in trapping mode.

Inset 760 is a cross-sectional view of the circular electrode pads of FIG. 7, a corresponding set of circular electrodes above the circular electrode pads of FIG. 7, and the electrical field both set of electrodes produce in the cylindrical gap between them in injection mode. Inset 760 shows that shifting injection axis 715 with respect to central axis 725 places all of the injected positive ions 710 entirely within the focusing region (depicted by arrows 765) of the electric field between electrodes.

Inset 770 is a cross-sectional view of the circular electrode pads of FIG. 7, a corresponding set of circular electrodes above the circular electrode pads of FIG. 7, and the paths of positive ions in both injection mode and trapping mode. Inset 770 shows that when positive ions 710 are initially injected within the focusing region, they remain stabilized in path 750 in injection mode and in path 755 in trapping mode. As a result, shifting injection axis 715 with respect to central axis 725 of gap 720 and towards positively biased electrode pad 740 stabilizes positive ions in both injection mode and in trapping mode.

Similarly, negative ions (not shown) can be injected into a focusing region. In order to place negative ions in a focusing region, the injection axis of the negative ions is shifted with respect to a central axis of a gap between a positively biased electrode pad and negatively biased electrode pad towards the negatively biased electrode pad. Therefore, in various embodiments, the injection axis of ions is shifted with respect to a central axis of a gap between a positively biased electrode pad and negatively biased electrode pad towards the electrode pad with the same polarity as the polarity of the ions.

System for Charged Particle Stability

Figure 8:
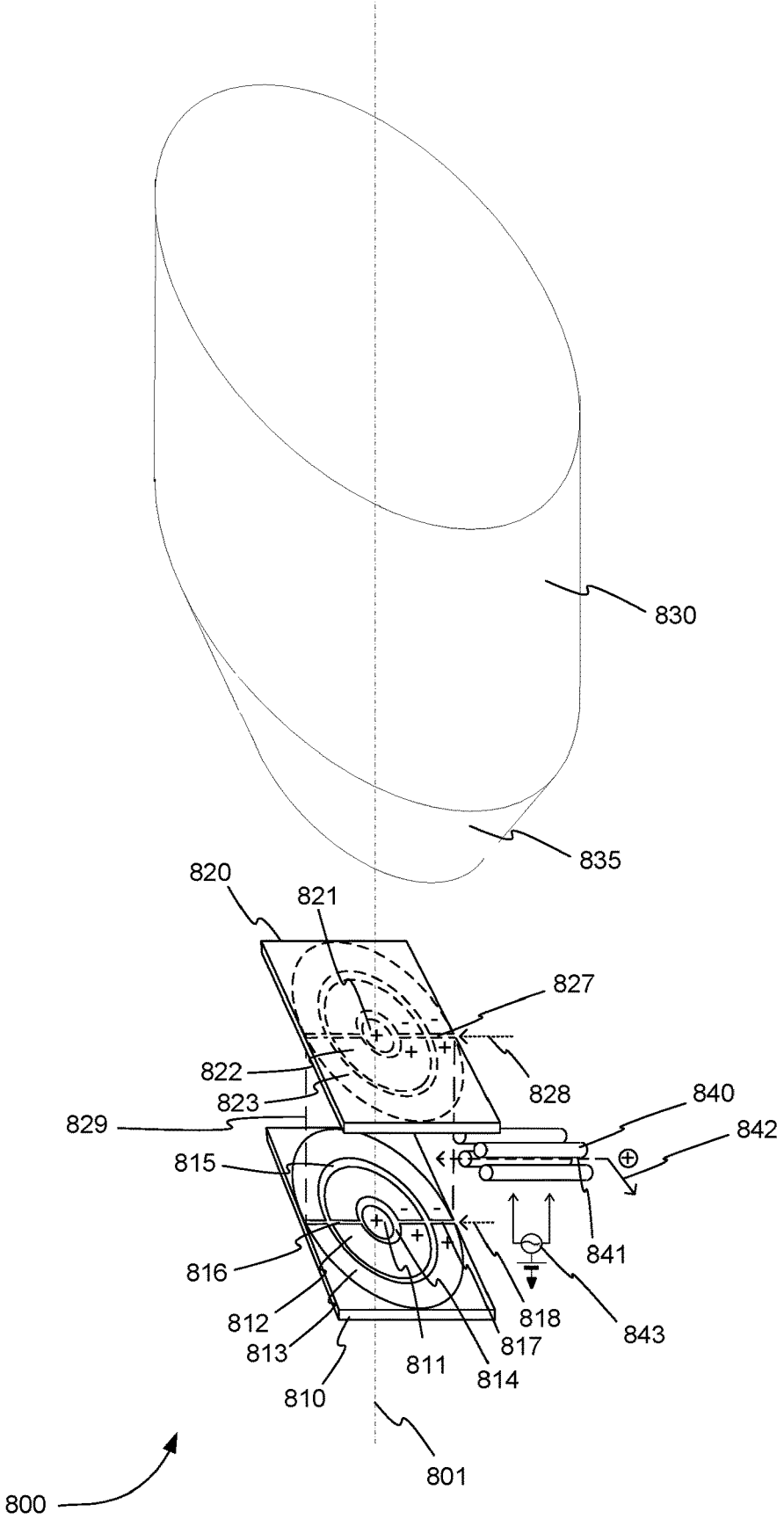
FIG. 8 is an exploded, oblique, and three-dimensional view of a side-on injection Penning trap that includes a charged particle injection device for injecting charged particles in a focusing region of an electric field, in accordance with various embodiments.

FIG. 8 is an exploded, oblique, and three-dimensional view 800 of a side-on injection Penning trap that includes a charged particle injection device for injecting charged particles in a focusing region of an electric field, in accordance with various embodiments. The side-on injection Penning trap includes first printed circuit board (PCB) 810 on which is printed a first set of electrodes.

The first set of electrodes includes a central disk electrode 811 and two segmented ring electrodes 812 and 813. Central disk electrode 811 and the next adjacent concentric segmented ring electrode 812 are separated by circular non-conducting path 814. Concentric segmented ring electrodes 812 and 813 are separated by a circular non-conducting path 815.

Concentric segmented ring electrodes 812 and 813 are segmented by at least two radial non-conducting paths 816 and 817 extending from circular non-conducting path 814 around the central disk electrode to the outer edge of outermost segmented ring electrode 813.

The side-on injection Penning trap includes second PCB 820. A second set of electrodes is printed on second PCB 820. The second set of electrodes corresponds in shape and size to the first set of electrodes that is printed on first PCB 810. Second PCB 820 is placed in parallel with first PCB 810 so that the second set of electrodes and the first of electrodes are coaxial and so that each electrode and non-conducting path of the first set of electrodes faces a corresponding electrode and non-conducting path of the second set of electrodes. The first set of electrodes and the second set of electrodes share axis 801, for example. The space between the first set of electrodes and the second set of electrodes is a cylindrical gap used to trap charged particles. The first set of electrodes and the second set of electrodes are biased to apply a quadrupole electric field to the cylindrical gap. The first set of electrodes and second set of electrodes are electrically connected to one or more voltage sources (not shown), for example.

The side-on injection Penning trap further includes at least one permanent magnet 830. In various embodiments, at least one permanent magnet can instead be an electromagnet (e.g., a solenoid that generates a magnetic field when an electric current flows therethrough). At least one permanent magnet 830 is placed coaxially, along axis 801, with the first set of electrodes and second set of electrodes, but outside of the cylindrical gap. At least one permanent magnet 830 applies a magnetic field to the cylindrical gap that is coaxial with the cylindrical gap. In a preferred embodiment, two permanent magnets are used to apply the magnetic field to the cylindrical gap. At least one permanent magnet 830 can include a tapered or cone pure iron piece 835 to amplify or focus the magnetic field. The effects of the magnetic field and the quadrupole electric field combine to trap charged particles in the cylindrical gap.

The side-on injection Penning trap further includes charged particle injection device 840 configured to inject charged particles into the cylindrical gap in a direction perpendicular to the magnetic field and parallel to a radial non-conducting path 817 of the first set of electrodes and a corresponding radial non-conducting path 827 of the second set of electrodes. Because the charged particles are injected in the side of the cylindrical gap, the Penning trap is called a side-on injection Penning trap.

In injection mode, segments of the concentric segmented ring electrodes 812 and 813 of the first set of electrodes on opposite sides of radial non-conducting path are 817 oppositely biased and segments of concentric segmented ring electrodes 822 and 823 of the second set of electrodes on opposite sides of corresponding radial non-conducting path 827 are correspondingly oppositely biased. This biasing produces an electric field in the cylindrical gap between radial non-conducting path 817 and corresponding radial non-conducting path 827 that has a focusing region and a defocusing region.

In injection mode, charged particle injection device 840 injects charged particles into the cylindrical gap along axis of injection 841 that is shifted from axis 818 of radial non-conducting path 817 and axis 828 of corresponding radial non-conducting path 827. Axis of injection 841 is shifted towards segments of concentric segmented ring electrodes 812 and 813 of the first set of electrodes and towards segments of the corresponding concentric segmented ring electrodes 822 and 823 of the second set of electrodes that are biased with the same polarity as the polarity of the charged particles so that the charged particles are injected in the focusing region.

For example, if the segments of concentric segmented ring electrodes 812 and 813 of the first set of electrodes and ring electrodes 822 and 823 of the second set of electrodes are biased as shown in FIG. 8, and if the charged particles have a positive polarity, axis of injection 841 is shifted in direction 842 with respect to axes 818 and 828. In other words, if the charged particles have a positive polarity, axis of injection 841 is shifted in direction 842 toward the segments with a positive polarity.

Figure 3:
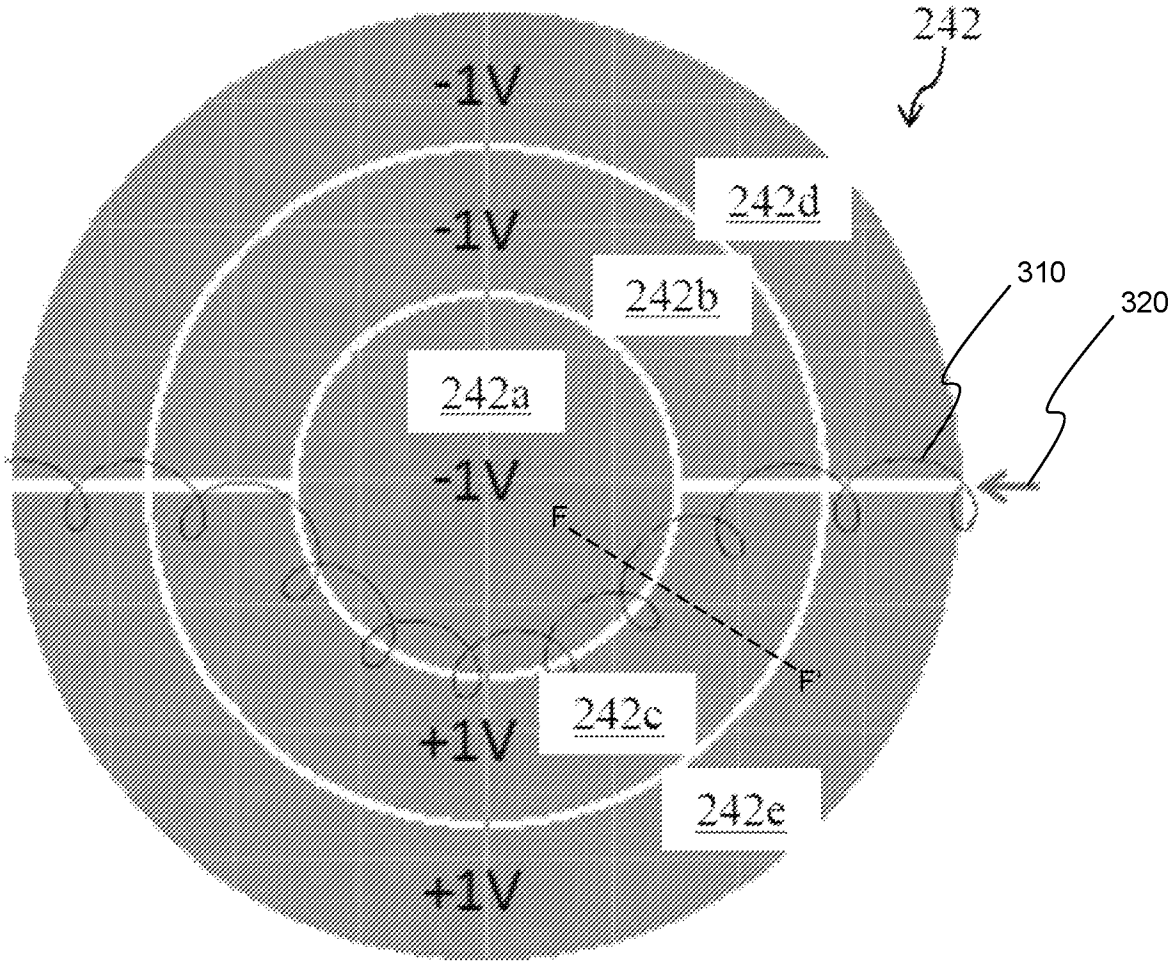
FIG. 3 (PRIOR ART)
FIG. 3 is an exemplary schematic diagram of an electrode of the side-on injection FT-ICR system of FIG. 2.

Note that in contrast to FIGS. 3 and 6, central disk electrodes 811 and 821 in FIG. 8 are biased positively in injection mode for positive charged particles. This biasing of central disk electrodes 811 and 821 is a preferred embodiment. More generally, in preferred embodiments, central disk electrodes are biased so that they keep their polarity in both the injection mode and the trapping mode. In other words, the bias of central disk electrodes is preferably not changed between the injection and trapping modes.

In various embodiments, the side-on injection Penning trap further includes control circuitry (not shown) to control the quadrupole electric field. This control circuitry can include, but is not limited to, an analog circuit, a digital circuit, a microcontroller, or a processor (or computer system, such as the computer system of FIG. 6).

In various embodiments, the charged particles comprise ions and the side-on injection Penning trap is used in Fourier transform ion cyclotron resonance (FT-ICR) mass spectrometry.

In various embodiments, charged particle injection device 840 is mechanically shifted perpendicular to plane 829 that includes axis 818 of radial non-conducting path 817 and axis 828 of corresponding radial non-conducting path 827. In other words, axis of injection 841 is shifted by mechanically or structurally shifting charged particle injection device 840 in direction 842.

In various embodiments, charged particle injection device 842 is a solid rod radio frequency (RF) quadrupole ion guide, as shown in FIG. 8. Charged particle injection device 842 includes RF source 843, for example.

Figure 9:
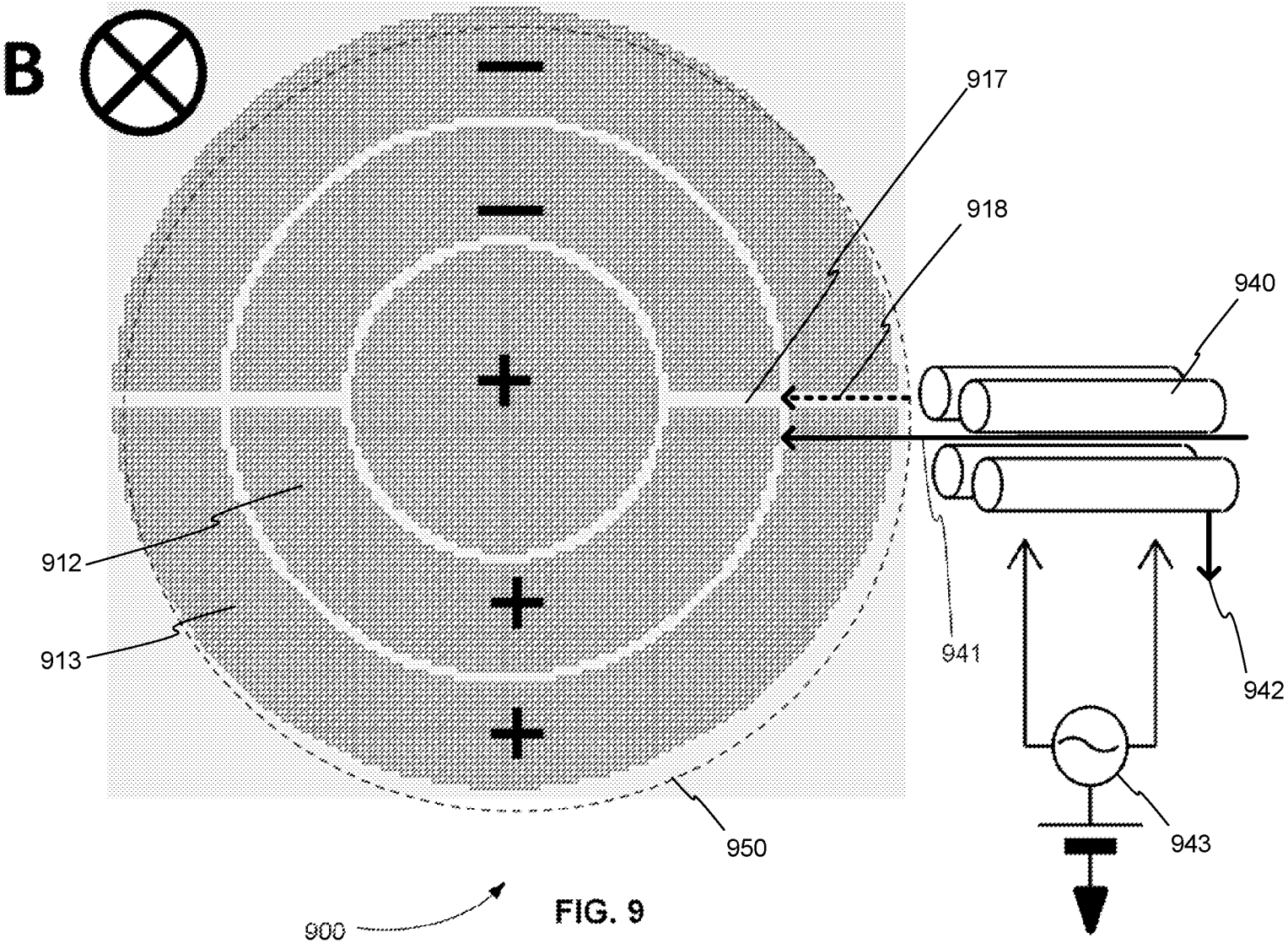
FIG. 9 is a top view of a side-on injection Penning trap that includes a solid rod radio frequency (RF) quadrupole ion guide as a charged particle injection device showing how the ion guide is mechanically shifted to inject positively charged particles in a focusing region of an electric field, in accordance with various embodiments.

FIG. 9 is a top view 900 of a side-on injection Penning trap that includes a solid rod RF quadrupole ion guide as a charged particle injection device showing how the ion guide is mechanically shifted to inject positively charged particles in a focusing region of an electric field, in accordance with various embodiments. Solid rod RF quadrupole ion guide 940 is mechanically shifted to shift axis of injection 941 of ion guide 940 with respect to axis 918 of radial non-conducting path 917 of a first set of electrodes. For positively charged particles, ion guide 940 is mechanically shifted in direction 942 toward the positively biased segments of concentric segmented ring electrodes 912 and 913 of the first set of electrodes. The positively charged particles are injected in the cylindrical gap between the first set of electrodes and a second set of electrodes. Dotted line 950 depicts the outline of the second set of electrodes above the first set of electrodes. Ion guide 940 includes RF source 943, for example.

Returning to FIG. 8, in various embodiments charged particle injection device 842 is constructed on the PCBs that also compose the side-on injection Penning trap. On each PCB, the injection device is composed of three electrode pads. Two outside electrode pads work as a quadrupole, and the center electrode pad works as a direct current (DC) electrode pad. By applying RF voltage on the outside four pads (on the two PCBs) in quadrupole manner, ions are trapped in radial direction. The DC pad is inserted between the RF pads to minimize the PCB substrate (dielectric material) facing the charged particles. The shape of the DC pad can be a trapezoid, and the narrow side is facing the side-on injection Penning trap. When charged particles are being injected into the side-on injection Penning trap, the DC pad is biased higher than the RF pads. This DC voltage condition generates a pushing force on the charged particles toward the side-on injection Penning trap.

Figure 10:
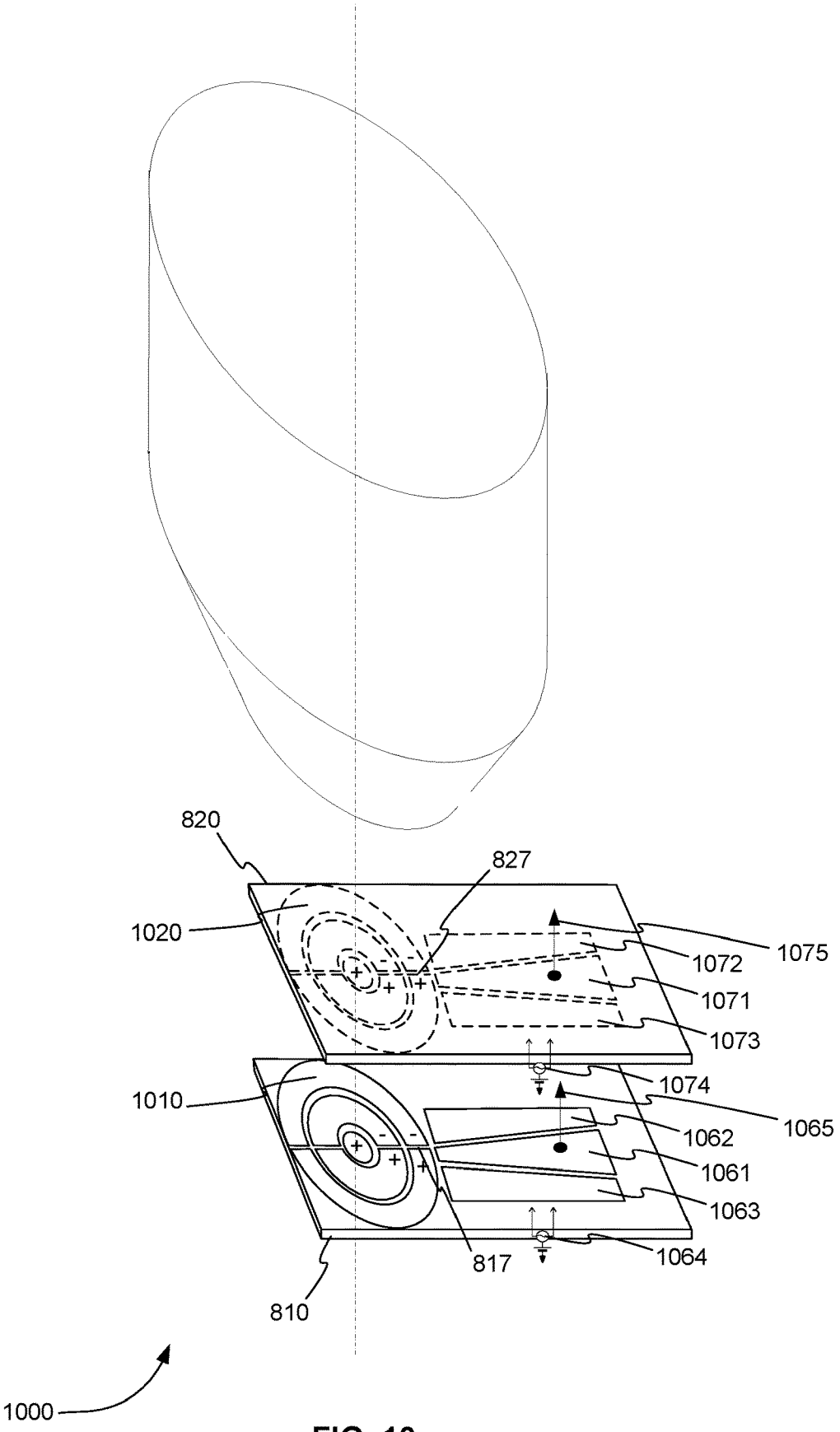
FIG. 10 is an exploded, oblique, and three-dimensional view of a side-on injection Penning trap that includes a charged particle injection device constructed on the PCBs of the side-on injection Penning trap for injecting charged particles in a focusing region of an electric field, in accordance with various embodiments.

FIG. 10 is an exploded, oblique, and three-dimensional view 1000 of a side-on injection Penning trap that includes a charged particle injection device constructed on the PCBs of the side-on injection Penning trap for injecting charged particles in a focusing region of an electric field, in accordance with various embodiments. The charged particle injection device includes a third set of three trapezoidal electrodes printed outside of first set of electrodes 1010 on first PCB 810 and a fourth set of three trapezoidal electrodes printed outside of second set of electrodes 1020 on second PCB 820.

The third set of three trapezoidal electrodes includes central trapezoidal electrode 1061 and outer trapezoidal electrodes 1062 and 1063. The fourth set of three trapezoidal electrodes includes central trapezoidal electrode 1071 and outer trapezoidal electrodes 1072 and 1073. Central trapezoidal electrodes 1061 and 1071 each have two diagonal sides of equal length and a width that tapers toward first set of electrodes 1010 or second set of electrodes 1020.

Outer trapezoidal electrodes 1062 and 1063 on either side of central trapezoidal electrode 1061 each have a diagonal side adjacent to a diagonal side of central trapezoidal electrode 1061 and a horizontal side opposite the diagonal side. Outer trapezoidal electrodes 1062 and 1063 have a width that tapers away from first set of electrodes 1010. Outer trapezoidal electrodes 1062 and 1063 together with the central trapezoidal electrode 1061 form a rectangular shape.

Correspondingly, outer trapezoidal electrodes 1072 and 1073 on either side of central trapezoidal electrode 1071 each have a diagonal side adjacent to a diagonal side of central trapezoidal electrode 1071 and a horizontal side opposite the diagonal side. Outer trapezoidal electrodes 1072 and 1073 have a width that tapers away from second set of electrodes 1020. Outer trapezoidal electrodes 1072 and 1073 together with the central trapezoidal electrode 1071 form a rectangular shape.

The three trapezoidal electrodes of the third set of electrodes and the fourth set of electrodes correspond in shape and size. Corresponding electrodes of the third set of electrodes and the fourth set of electrodes face each other across an axial gap between the third set of electrodes and the fourth set of electrodes.

Outer trapezoidal electrodes 1062 and 1063 of the third set of electrodes and outer trapezoidal electrodes 1072 and 1073 of the fourth set of electrodes are biased with an RF voltage to apply a quadrupole electric field to the axial gap. This RF voltage is supplied by RF voltages sources 1064 and 1074, respectively, for example. Central trapezoidal electrodes 1061 and 1071 are biased with a DC voltage, using DC voltage sources 1065 and 1075, respectively, for example. Central trapezoidal electrodes 1061 and 1071 are biased with a DC voltage to minimize the effects of the dielectric material of first PCB 810 and second PCB 820, respectively.

The charged particle injection device constructed on PCBs 810 and 820 is mechanically shifted by printing the third set of electrodes on first PCB 810 shifted from the axis of radial non-conducting path 817 and printing the fourth set of electrodes on the second PCB shifted from the axis of corresponding radial non-conducting path 827.

Figure 11:
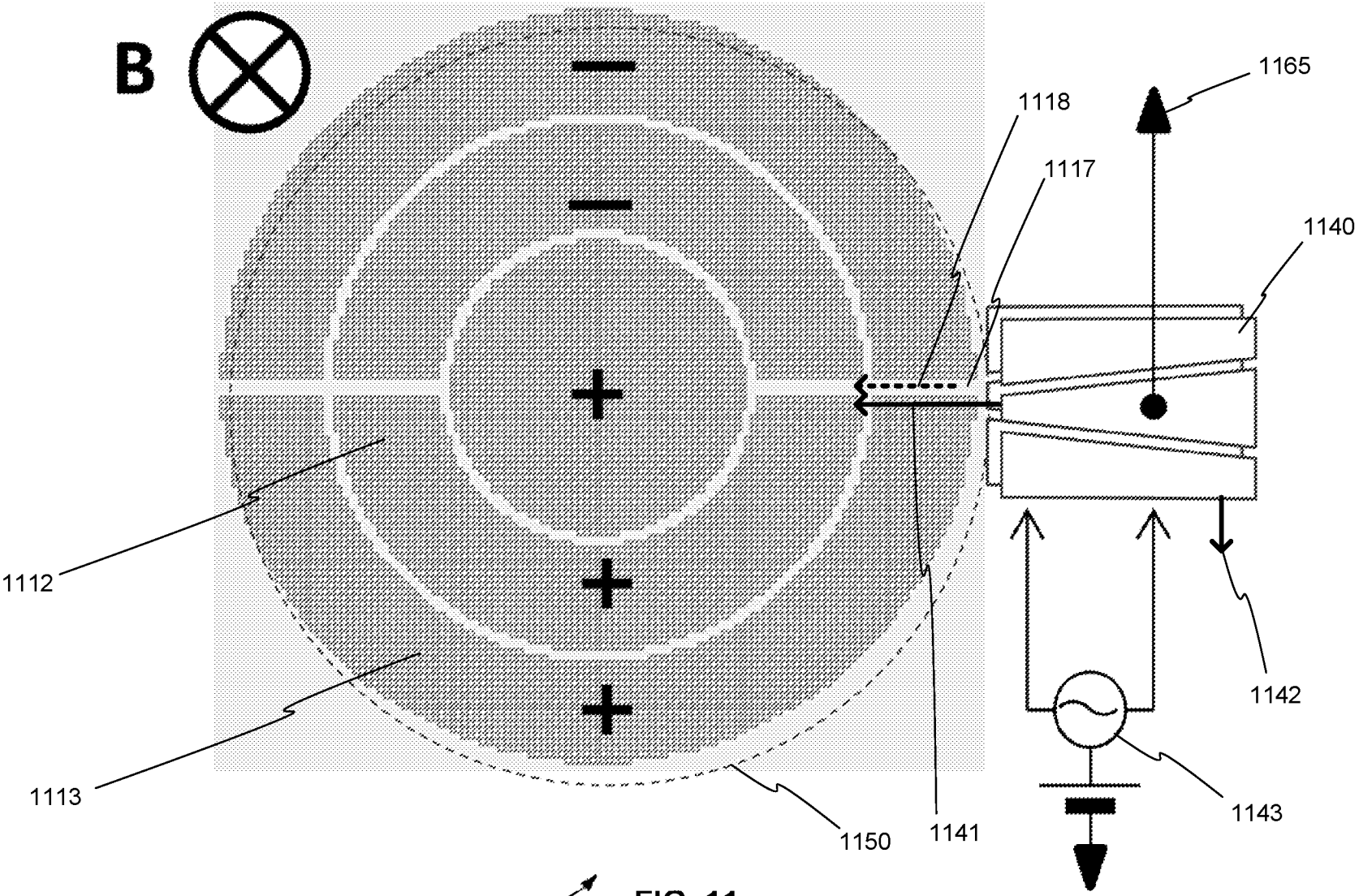
FIG. 11 is a top view of a side-on injection Penning trap that includes a charged particle injection device constructed on the PCBs of the side-on injection Penning trap showing how the injection device is mechanically shifted to inject positively charged particles in a focusing region of an electric field, in accordance with various embodiments.

FIG. 11 is a top view 1100 of a side-on injection Penning trap that includes a charged particle injection device constructed on the PCBs of the side-on injection Penning trap showing how the injection device is mechanically shifted to inject positively charged particles in a focusing region of an electric field, in accordance with various embodiments. The electrodes of charged particle injection device 1140 are printed on the PCBs of the side-on injection Penning trap to shift axis of injection 1141 with respect to axis 1118 of radial non-conducting path 1117 of a first set of electrodes. For positively charged particles, charged particle injection device 1140 is mechanically shifted in direction 1142 toward the positively biased segments of concentric segmented ring electrodes 1112 and 1113 of the first set of electrodes of the side-on injection Penning trap. The positively charged particles are injected in the cylindrical gap between the first set of electrodes and a second set of electrodes. Dotted line 1150 depicts the outline of the second set of electrodes above the first set of electrodes. Charged particle injection device 1140 includes RF source 1143 and DC source 1165, for example.

In various embodiments, the axis of injection of charged particles is shifted without mechanically shifting a charged particle injection device. Instead, the charged particle injection device is biased to electrically shift the axis of injection of the charged particles.

Figure 12:
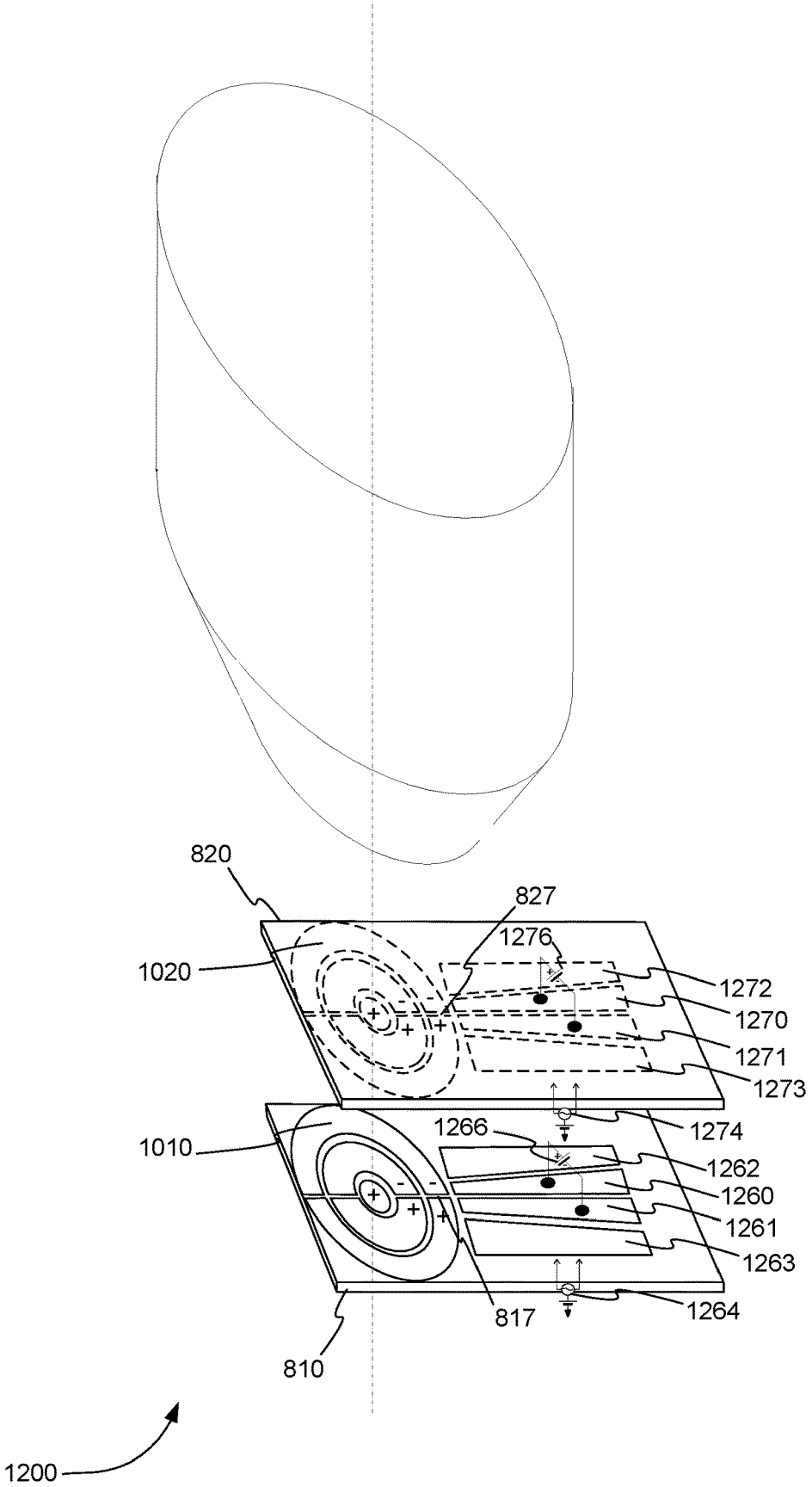
FIG. 12 is an exploded, oblique, and three-dimensional view of a side-on injection Penning trap that includes a charged particle injection device constructed on the PCBs of the side-on injection Penning trap for injecting charged particles in a focusing region of an electric field without mechanically shifting the charged particle injection device, in accordance with various embodiments.

FIG. 12 is an exploded, oblique, and three-dimensional view 1200 of a side-on injection Penning trap that includes a charged particle injection device constructed on the PCBs of the side-on injection Penning trap for injecting charged particles in a focusing region of an electric field without mechanically shifting the charged particle injection device, in accordance with various embodiments. The charged particle injection device includes a third set of four trapezoidal electrodes printed outside of first set of electrodes 1010 on first PCB 810 and a fourth set of four trapezoidal electrodes printed outside of second set of electrodes 1020 on second PCB 820.

The third set of four trapezoidal electrodes includes two central trapezoidal electrodes 1260 and 1261 and two outer trapezoidal electrodes 1262 and 1263. The fourth set of three trapezoidal electrodes includes two central trapezoidal electrodes 1270 and 1271 and two outer trapezoidal electrodes 1272 and 1273.

Central trapezoidal electrodes 1260 and 1261 each have a horizontal side along the axis of the charged particle injection device and a diagonal side opposite the horizontal side. Central trapezoidal electrodes 1260 and 1261 each have a width that tapers toward first set of electrodes 1010. Two outer trapezoidal electrodes 1262 and 1263 on either side of two central trapezoidal electrodes 1260 and 1261 each have a diagonal side adjacent to a diagonal side of a central trapezoidal electrode and a horizontal side opposite the diagonal side. Two outer trapezoidal electrodes 1262 and 1263 each have a width that tapers away from first set of electrodes 1010. Together two outer trapezoidal electrodes 1262 and 1263 and two central trapezoidal electrodes 1260 and 1261 form a rectangular shape.

Correspondingly, central trapezoidal electrodes 1270 and 1271 each have a horizontal side along the axis of the charged particle injection device and a diagonal side opposite the horizontal side. Central trapezoidal electrodes 1270 and 1271 each have a width that tapers toward first set of electrodes 1010. Two outer trapezoidal electrodes 1272 and 1273 on either side of two central trapezoidal electrodes 1270 and 1271 each have a diagonal side adjacent to a diagonal side of a central trapezoidal electrode and a horizontal side opposite the diagonal side. Two outer trapezoidal electrodes 1272 and 1273 each have a width that tapers away from first set of electrodes 1020. Together two outer trapezoidal electrodes 1272 and 1273 and two central trapezoidal electrodes 1270 and 1271 form a rectangular shape.

The four trapezoidal electrodes of the third set of electrodes and the fourth set of electrodes correspond in shape and size. Corresponding electrodes of the third set of electrodes and the fourth set of electrodes face each other across an axial gap between the third set of electrodes and the fourth set of electrodes.

Outer trapezoidal electrodes 1262 and 1263 of the third set of electrodes and outer trapezoidal electrodes 1272 and 1273 of the fourth set of electrodes are biased with an RF voltage to apply a quadrupole electric field to the axial gap. This RF voltage is supplied by RF voltages sources 1264 and 1274, respectively, for example. Central trapezoidal electrodes 1060, 1061, 1070, and 1071 are biased with a DC voltage. Central trapezoidal electrodes 1060, 1061, 1070, and 1071 are biased with a DC voltage to minimize the effects of the dielectric material of first PCB 810 and second PCB 820, respectively.

The third set of electrodes is printed on first PCB 810 to share the axis of radial non-conducting path 817. In other words, the third set of electrodes is not mechanically shifted. Instead, a DC voltage is applied across two central electrodes 1260 and 1261 of the third set of electrodes. This DC voltage causes charged particles to be injected into the cylindrical gap along an axis of injection that is shifted from the axis of radial non-conducting path 817. The DC voltage is applied using DC voltage source 1266, for example.

Correspondingly, the fourth set of electrodes is printed on second PCB 820 to share the axis of radial non-conducting path 827. In other words, the fourth set of electrodes is not mechanically shifted. Instead, a DC voltage is applied across two central electrodes 1270 and 1271 of the third set of electrodes. This DC voltage causes charged particles to be injected into the cylindrical gap along an axis of injection that is shifted from the axis of radial non-conducting path 827. The DC voltage is applied using DC voltage source 1276, for example.

Figure 13:
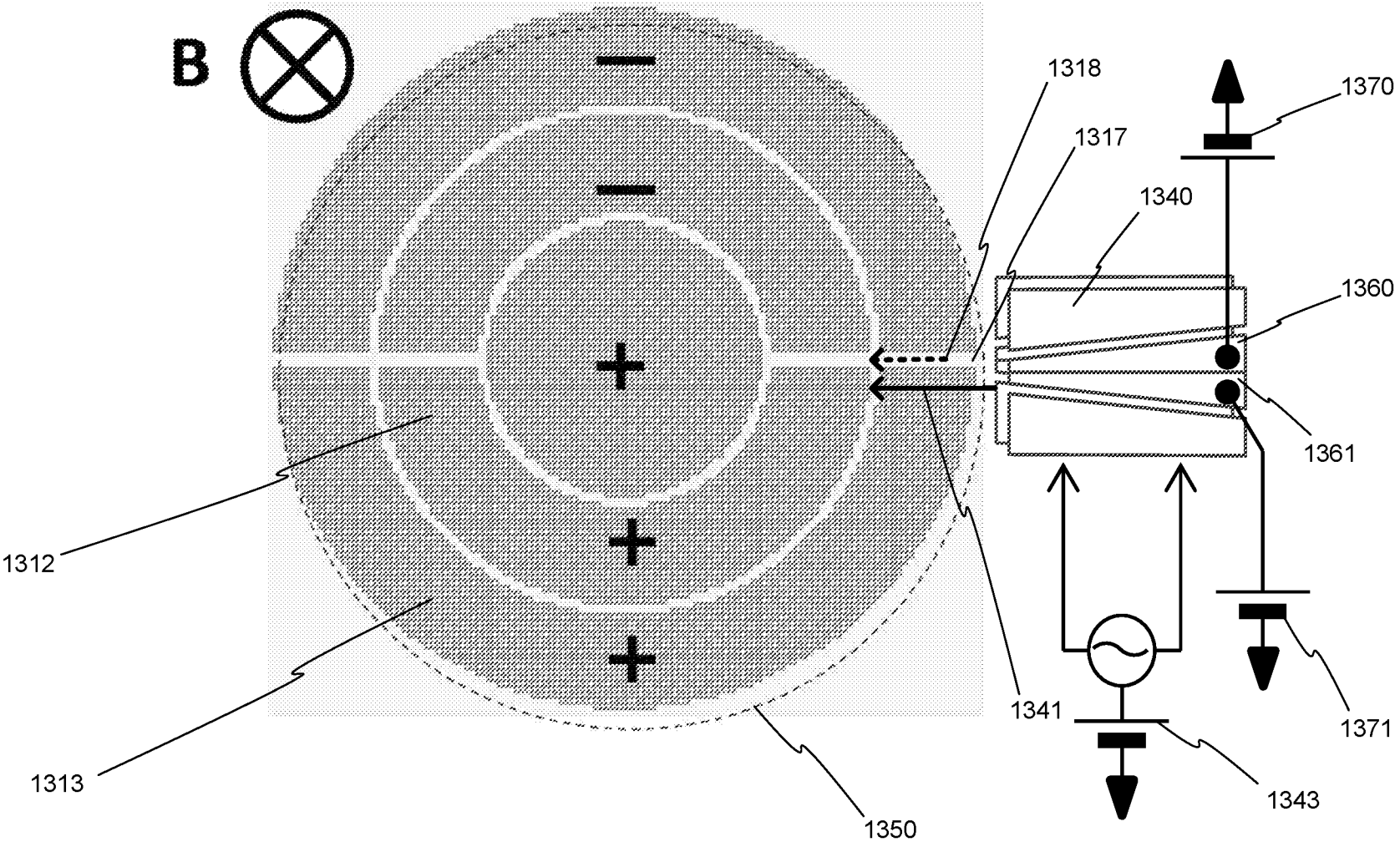
FIG. 13 is a top view of a side-on injection Penning trap that includes a charged particle injection device constructed on the PCBs of the side-on injection Penning trap showing how the injection device is electrically biased to inject positively charged particles in a focusing region of an electric field, in accordance with various embodiments.

FIG. 13 is a top view 1300 of a side-on injection Penning trap that includes a charged particle injection device constructed on the PCBs of the side-on injection Penning trap showing how the injection device is electrically biased to inject positively charged particles in a focusing region of an electric field, in accordance with various embodiments. The electrodes of charged particle injection device 1340 are printed on the PCBs of the side-on injection Penning trap. These electrode, however, are not printed mechanically shifted with respect to a first set of electrodes of the side-on injection Penning trap. Instead, they are biased to shift axis of injection 1341 with respect to axis 1318 of radial non-conducting path 1317 of the first set of electrodes.

For example, a DC voltage is applied across central trapezoidal electrodes 1360 and 1361 of charged particle injection device 1340. The DC voltage is applied using voltage sources 1370 and 1371, for example. For positively charged particles, central trapezoidal electrode 1360 is given a higher voltage than central trapezoidal electrode 1361. This causes the positively charged particles to move closer to central trapezoidal electrode 1361 and to shift axis of injection 1341 away from axis 1318 of radial non-conducting path 1317 of the first set of electrodes. Axis of injection 1341 is shifted towards the positively biased segments of concentric segmented ring electrodes 1312 and 1313 of the first set of electrodes of the side-on injection Penning trap. The positively charged particles are injected in the cylindrical gap between the first set of electrodes and a second set of electrodes. Dotted line 1350 depicts the outline of the second set of electrodes above the first set of electrodes. Charged particle injection device 1340 also includes RF source 1343 that applies an RF voltage to the outer trapezoidal electrodes of charged particle injection device 1340, for example.

Also note that FIG. 12 one voltage source is used to create a voltage difference across the inner trapezoidal electrodes, and in FIG. 13 two voltage sources are used to create a voltage difference across the inner trapezoidal electrodes. One skilled in the art can appreciate that these are two alternative embodiments.

Method for Charged Particle Stability

Figure 14:
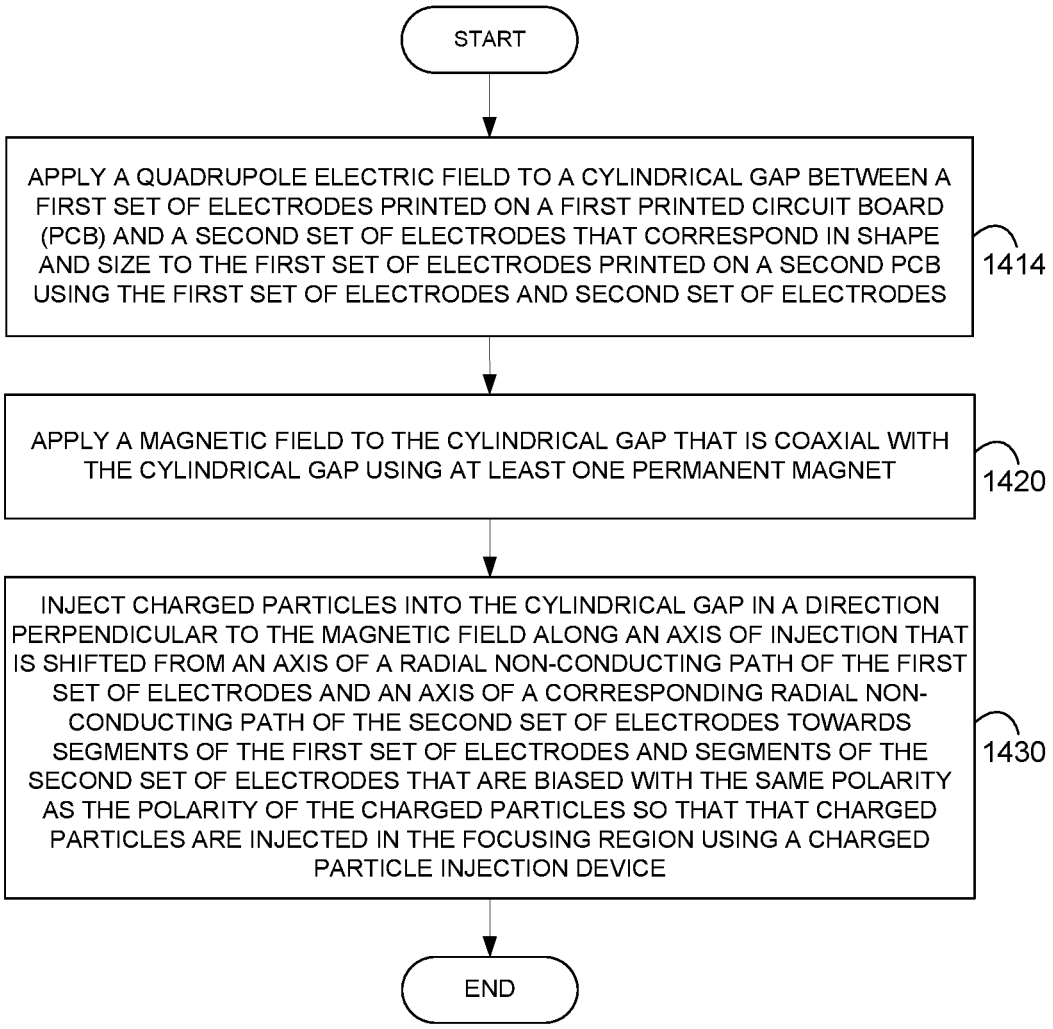
FIG. 14 is a flowchart showing a method for injecting charged particles in a focusing region of an electric field in a side-on injection Penning trap, in accordance with various embodiments.

FIG. 14 is a flowchart showing a method 1400 for injecting charged particles in a focusing region of an electric field in a side-on injection Penning trap, in accordance with various embodiments.

In step 1410 of method 1400, a quadrupole electric field is applied to a cylindrical gap between a first set of electrodes printed on a first printed circuit board (PCB) and a second set of electrodes that correspond in shape and size to the first set of electrodes printed on a second PCB using the first set of electrodes and second set of electrodes. The first set of electrodes and the second set of electrodes each include a central disk electrode and one or more concentric segmented ring electrodes. The central disk electrode and the next adjacent concentric segmented ring electrode are separated by a circular non-conducting path and each concentric segmented ring electrode is separated by the next adjacent concentric segmented ring electrode by a circular non-conducting path. Each of the one or more concentric segmented ring electrodes is segmented by at least two radial non-conducting paths extending from the circular non-conducting path around the central disk electrode to the outer edge of the outermost segmented ring electrode. The second PCB is placed in parallel with the first PCB so that the second set of electrodes and the first of electrodes are coaxial and so that each electrode and non-conducting path of the first set of electrodes faces a corresponding electrode and non-conducting path of the second set of electrodes.

The space between the first set of electrodes and the second set of electrodes is a cylindrical gap used to trap charged particles. The first set of electrodes and the second set of electrodes are biased to apply a quadrupole electric field to the cylindrical gap.

In step 1420, a magnetic field is applied to the cylindrical gap that is coaxial with the cylindrical gap using at least one permanent magnet. The at least one permanent magnet is placed coaxially with the first set of electrodes and the second set of electrodes but outside of the cylindrical gap. The effects of the magnetic field and the quadrupole electric field combine to trap charged particles in the cylindrical gap.

In step 1430, charged particles are injected into the cylindrical gap in a direction perpendicular to the magnetic field using a charged particle injection device. The charged particles are injected along an axis of injection that is shifted from an axis of a radial non-conducting path of the first set of electrodes and an axis of a corresponding radial non-conducting path of the second set of electrodes. The axis of injection is shifted towards segments of the first set of electrodes and segments of the second set of electrodes that are biased with the same polarity as the polarity of the charged particles so that the charged particles are injected in the focusing region.

The charged particles are injected into the cylindrical gap in a direction parallel to a radial non-conducting path of the first set of electrodes and a corresponding radial non-conducting path of the second set of electrodes. In the injection mode, segments of the concentric segmented ring electrodes of the first set of electrodes on opposite sides of the radial non-conducting path are oppositely biased and segments of the concentric segmented ring electrodes of the second set of electrodes on opposite sides of the corresponding radial non-conducting path are correspondingly oppositely biased. This biasing produces an electric field in the cylindrical gap between the radial non-conducting path and the corresponding radial non-conducting path that has a focusing region and a defocusing region.

In the injection mode, the charged particle injection device injects charged particles into the cylindrical gap along an axis of injection that is shifted from the axis of the radial non-conducting path and the axis of the corresponding radial non-conducting path. The axis of injection is shifted towards segments of the concentric segmented ring electrodes of the first set of electrodes and towards segments of the corresponding concentric segmented ring electrodes of the second set of electrodes that are biased with the same polarity as the polarity of the charged particles so that the charged particles are injected in the focusing region.

Compensating Electric Field for the Lorentz Force

Figure 5:
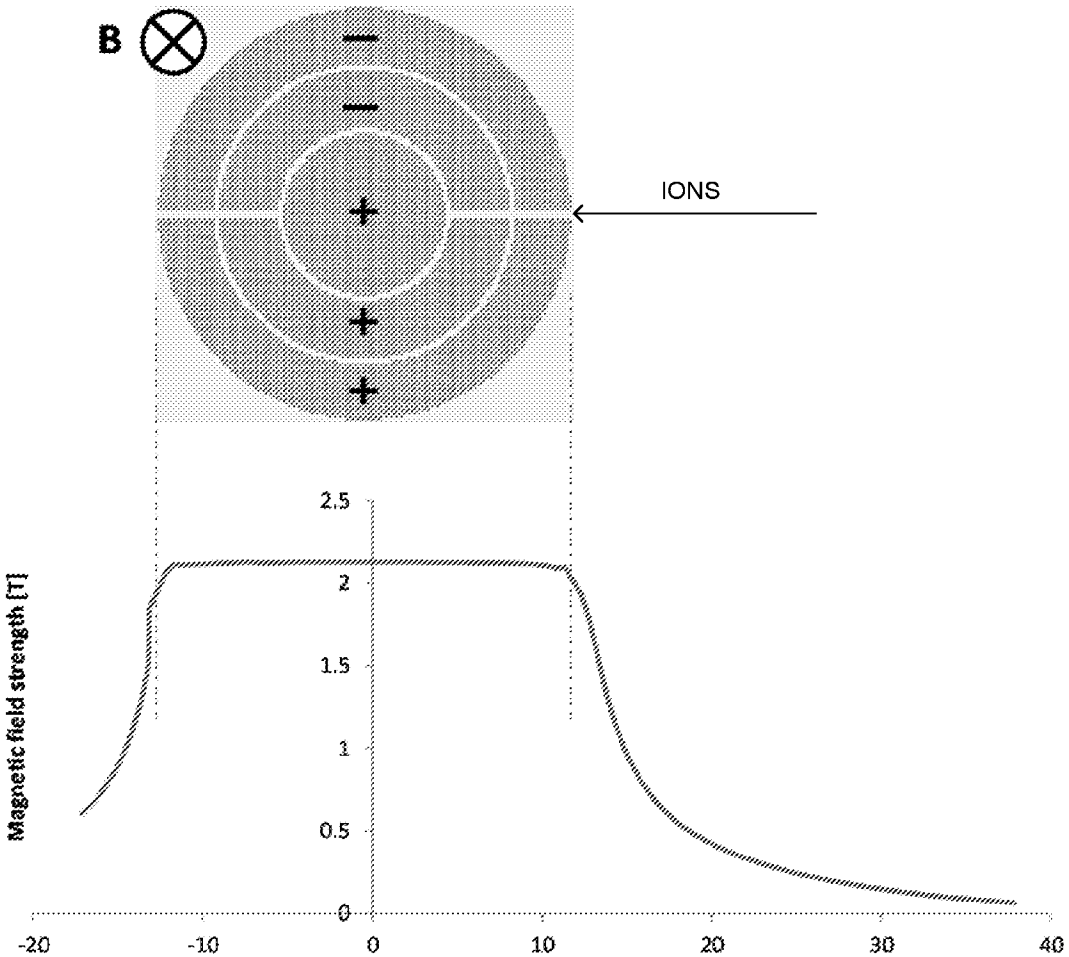
(PRIOR ART) FIG. 5
FIG. 5 is an exemplary plot showing how the magnetic field varies across a side-on Penning trap.

As described above and shown in FIG. 5, the magnetic field within a side-on injection Penning trap is constant or uniform. However, outside of the trap, the magnetic field quickly decreases in intensity. Therefore, ions entering the trap experience a sharply increasing magnetic field as they move toward the trap. The increasing magnetic field that ions experience as they are injected into a side-on injection Penning trap with a certain velocity produces a Lorentz force. This Lorentz force can cause the ions to be deflected away from the trap, preventing ion injection. As a result, systems and methods are needed to compensate for the Lorentz force that is produced when ions are injected into a side-on injection Penning trap.

In various embodiments, electrodes of a charged particle injection device of a side-on injection Penning trap are DC biased so that the electrodes produce an electric field along the axis of the charged particle injection device that compensates for the Lorentz force. The electric field is a dipolar electric field that increases proportionally with the increase in the magnetic field along the path of ions in the charged particle injection device. Tapered RF quadrupole electrode pads printed on the PCBs of the side-on injection Penning trap can be used to produce the dipolar electric field, for example.

System Biased to Compensate for the Lorentz Force

Figure 15:
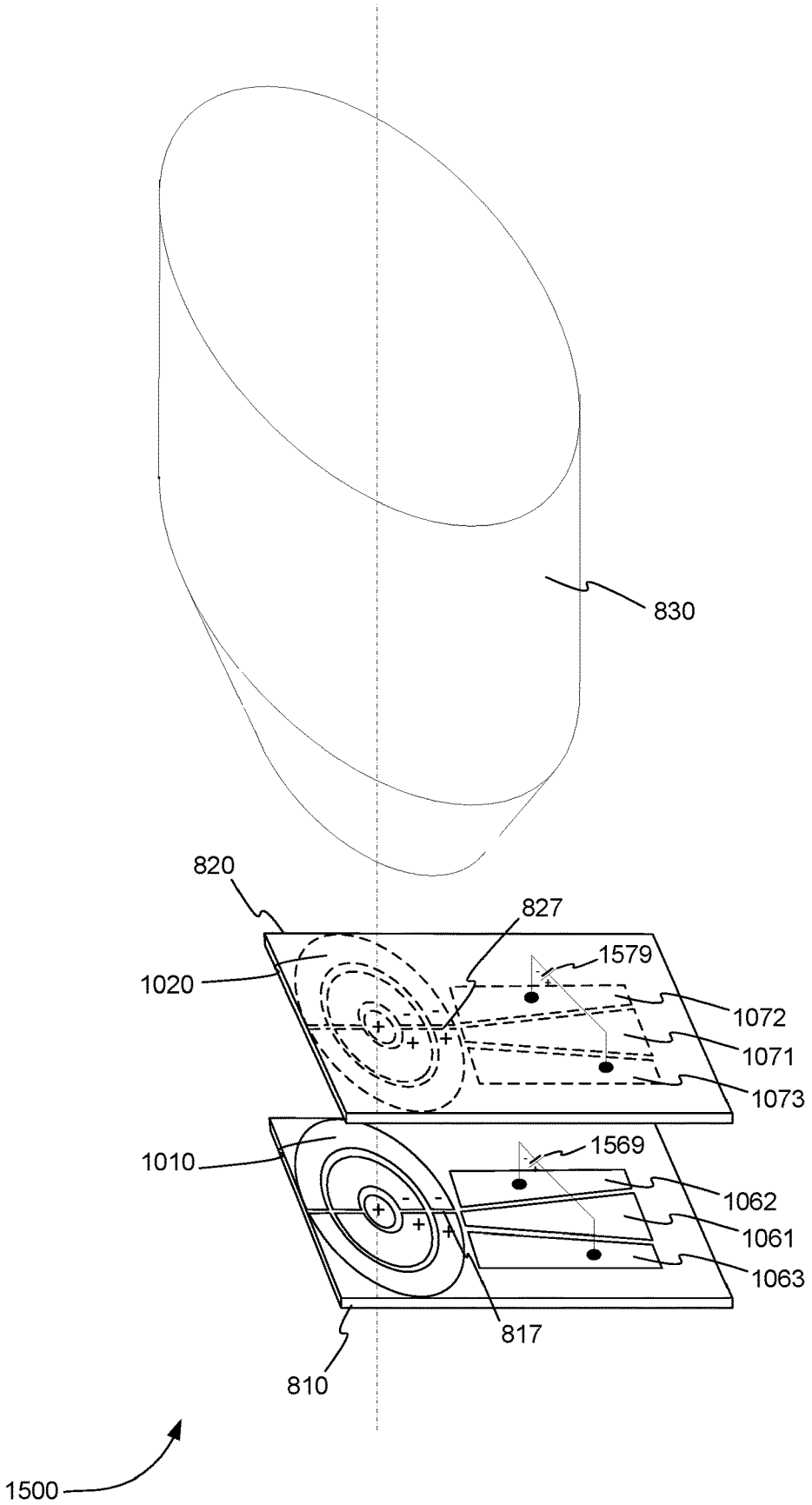
FIG. 15 is an exploded, oblique, and three-dimensional view of a side-on injection Penning trap that includes a charged particle injection device that is biased to compensate for a Lorentz force experienced by charged particles flowing through the charged particle injection device, in accordance with various embodiments.

FIG. 15 is an exploded, oblique, and three-dimensional view 1500 of a side-on injection Penning trap that includes a charged particle injection device that is biased to compensate for a Lorentz force experienced by charged particles flowing through the charged particle injection device, in accordance with various embodiments. The side-on injection Penning trap includes a first PCB 810 on which is printed a first set of two or more concentric circular or semi-circular electrodes 1010. The side-on injection Penning trap also includes a second PCB 820 on which is printed a second set of two or more concentric circular or semi-circular electrodes 1020. Second set of electrodes 1020 correspond in shape and size to first set of electrodes 1010.

Second PCB 820 is placed in parallel with first PCB 810 so that second set of electrodes 1020 faces and is coaxial with first set of electrodes 1010. The space between first set of electrodes 1010 and second set of electrodes 1020 is a cylindrical gap used to trap charged particles. First set of electrodes 1010 and second set of electrodes 1020 apply a quadrupole electric field to the cylindrical gap.

At least one permanent magnet 830 is placed coaxially with first set of electrodes 1010 and second set of electrodes 1020 but outside of the cylindrical gap. At least one permanent magnet 830 applies a magnetic field to the cylindrical gap that is coaxial with the cylindrical gap. The effects of the magnetic field and the quadrupole electric field combine to trap charged particles in the cylindrical gap.

A charged particle injection device is configured to inject charged particles into the cylindrical gap in a direction perpendicular to the magnetic field and biased to apply an electric field to the flow of charged particles in the charged particle injection device that compensates for a Lorentz force applied to the flow of charged particles in the charged particle injection device by the magnetic field outside of the cylindrical gap.

In various embodiments, the charged particle injection device includes a third set of three trapezoidal electrodes that are printed on first PCB 810 and a fourth set of three trapezoidal electrodes that are printed on second PCB 820. The third set of trapezoidal electrodes includes central trapezoidal electrode 1061 and two outer trapezoidal electrodes 1062 and 1063. Correspondingly, the fourth set of trapezoidal electrodes includes central trapezoidal electrode 1071 and two outer trapezoidal electrodes 1072 and 1073.

In order to compensate for a Lorentz force applied to the flow of charged particles in the charged particle injection device, outer trapezoidal electrodes 1062 and 1063 and outer trapezoidal electrodes 1072 and 1073 are DC biased. The DC bias produces dipolar electric field that increases proportionally with the increase in the magnetic field along the path of charged particles in the charged particle injection device. For positively charged particles, outer trapezoidal electrodes 1062 and 1063 are biased using DC voltage source 1569, and outer trapezoidal electrodes 1072 and 1073 are biased using DC voltage source 1579, for example.

Note that as in FIG. 10, the electrodes of the charged particle injection device in FIG. 15 are also printed on PCBS 810 and 820 so that they are shifted from radial non-conducting path 817 and corresponding radial non-conducting path 827. As a result, the electrodes of the charged particle injection device in FIG. 15 can both compensate for the Lorentz force produced by the magnetic field of the side-on injection Penning trap and improve the stability of the charged particles injected into the side-on injection Penning trap.

Figure 16:
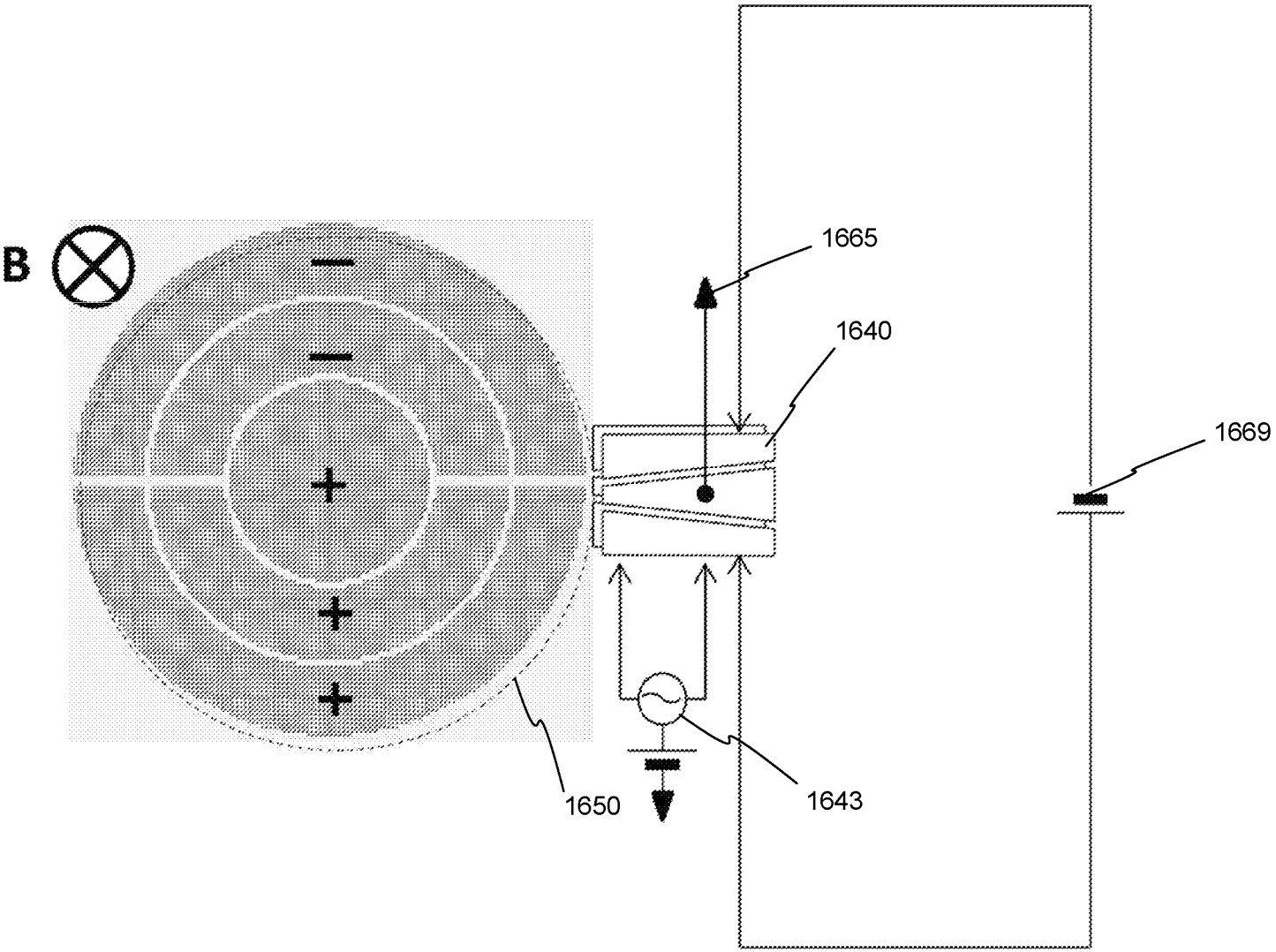
FIG. 16 is a top view of a side-on injection Penning trap that includes a charged particle injection device constructed on the PCBs of the side-on injection Penning trap showing how the injection device is electrically biased to compensate for the Lorentz force produced by the magnetic field of the side-on injection Penning trap, in accordance with various embodiments.

FIG. 16 is a top view 1600 of a side-on injection Penning trap that includes a charged particle injection device constructed on the PCBs of the side-on injection Penning trap showing how the injection device is electrically biased to compensate for the Lorentz force produced by the magnetic field of the side-on injection Penning trap, in accordance with various embodiments. The electrodes of charged particle injection device 1640 are printed on the PCBs of the side-on injection Penning trap. In order to compensate for the Lorentz force produced by the magnetic field of the side-on injection Penning trap, the outer trapezoidal electrodes of charged particle injection device 1640 are biased to produce a dipolar electric field perpendicular to the flow of charged particles in charged particle injection device 1640.

For positively charged particles, the outer trapezoidal electrodes of charged particle injection device 1640 are biased using DC voltage source 1669, for example. The positively charged particles are injected in the cylindrical gap between the first set of electrodes and a second set of electrodes. Dotted line 1650 depicts the outline of the second set of electrodes above the first set of electrodes. Charged particle injection device 1640 also includes RF source 1643 that applies an RF voltage to the outer trapezoidal electrodes of charged particle injection device 1640 and DC source 1665 that applies a DC voltage to the central trapezoidal electrodes of charged particle injection device 1640, for example.

Figure 17:
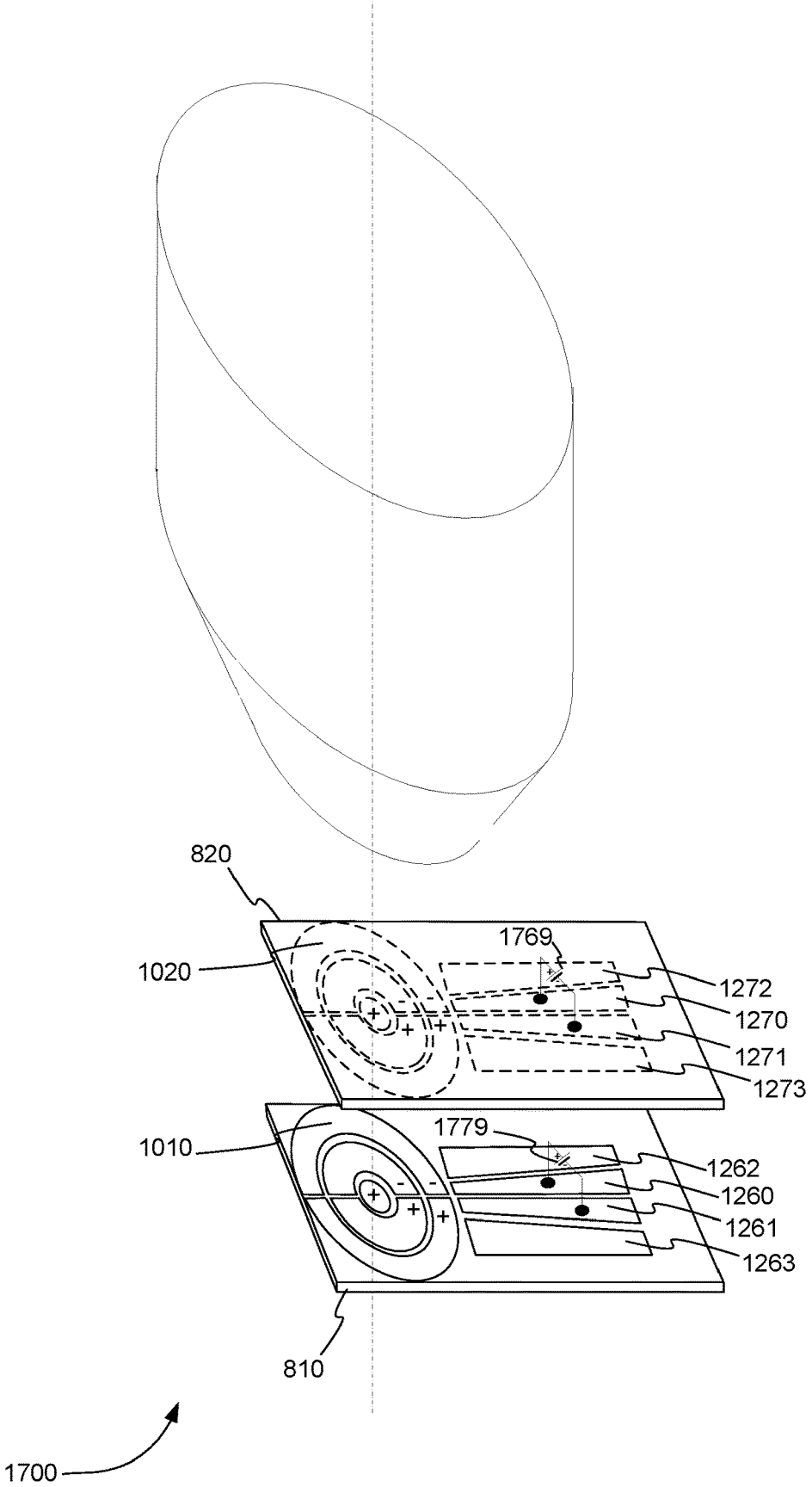
FIG. 17 is an exploded, oblique, and three-dimensional view of the side-on injection Penning trap of FIG. 12 showing how the charged particle injection device of the side-on injection Penning trap is biased to compensate for a Lorentz force experienced by charged particles flowing through the charged particle injection device, in accordance with various embodiments.

FIG. 17 is an exploded, oblique, and three-dimensional view 1700 of the side-on injection Penning trap of FIG. 12 showing how the charged particle injection device of the side-on injection Penning trap is biased to compensate for a Lorentz force experienced by charged particles flowing through the charged particle injection device, in accordance with various embodiments.

The side-on injection Penning trap includes a first PCB 810 on which is printed a first set of two or more concentric circular or semi-circular electrodes 1010. The side-on injection Penning trap also includes a second PCB 820 on which is printed a second set of two or more concentric circular or semi-circular electrodes 1020. Second set of electrodes 1020 correspond in shape and size to first set of electrodes 1010.

The charged particle injection device of the side-on injection Penning trap includes a third set of four trapezoidal electrodes 1260, 1261, 1262, and 1263 and a fourth set of four trapezoidal electrodes 1270, 1271, 1272, and 1273. In order to compensate for the Lorentz force produced by the magnetic field of the side-on injection Penning trap, a DC voltage is applied between inner trapezoidal electrodes 1260 and 1261 and between inner trapezoidal electrodes 1270 and 1271 of the charged particle injection device. DC voltage sources 1769 and 1779 are used, respectively, to apply these voltages.

Note that in FIG. 12 DC voltage sources 1266 and 1276 are similarly applied between inner trapezoidal electrodes 1260 and 1261 and between inner trapezoidal electrodes 1270 and 1271, respectively. DC voltage sources 1266 and 1276 are used to apply voltages to charged particles to be injected into the cylindrical gap along an axis of injection that is shifted from the axis of a radial non-conducting path. In various embodiments, DC voltage sources 1266 and 1769 can be the same voltage source, and DC voltage sources 1276 and 1779 can be the same voltage sources.

Figure 18:
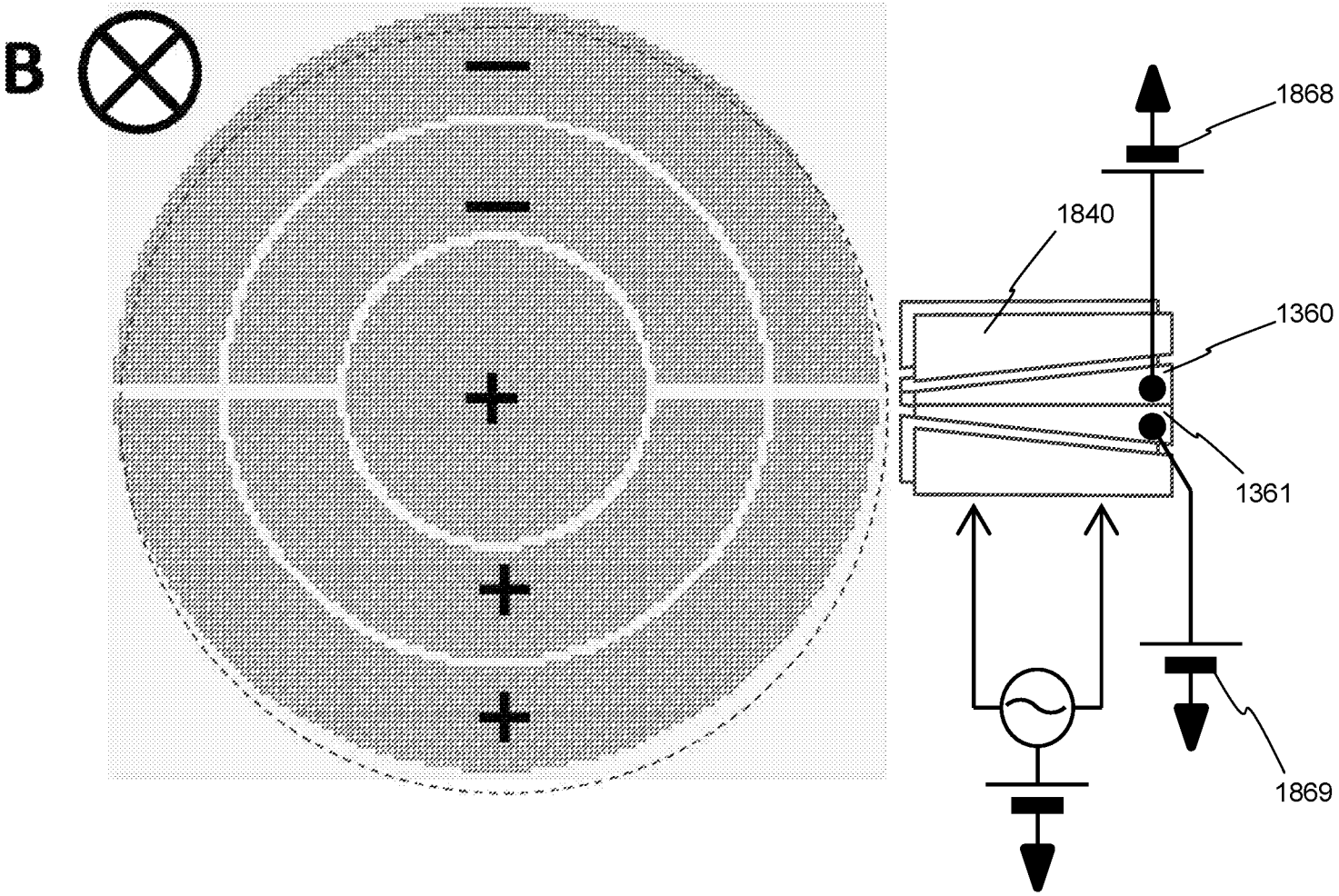
FIG. 18 is a top view of the side-on injection Penning trap of FIG. 13 showing how the charged particle injection device of the side-on injection Penning trap is biased to compensate for a Lorentz force experienced by charged particles flowing through the charged particle injection device, in accordance with various embodiments.

FIG. 18 is a top view 1800 of the side-on injection Penning trap of FIG. 13 showing how the charged particle injection device of the side-on injection Penning trap is biased to compensate for a Lorentz force experienced by charged particles flowing through the charged particle injection device, in accordance with various embodiments. The electrodes of charged particle injection device 1840 are printed on the PCBs of the side-on injection Penning trap.

In order to compensate for the Lorentz force produced by the magnetic field of the side-on injection Penning trap, the outer trapezoidal electrodes of charged particle injection device 1840 are biased to produce a dipolar electric field perpendicular to the flow of charged particles in charged particle injection device 1840. For positively charged particles, the inner trapezoidal electrodes of charged particle injection device 1840 are biased using DC voltage sources 1868 and 1869, for example.

Note that in FIG. 13 DC voltage sources 1370 and 1371 are similarly applied between inner trapezoidal electrodes 1360 and 1361. DC voltage sources 1370 and 1371 are used to apply voltages to charged particles to be injected into the cylindrical gap along an axis of injection that is shifted from the axis of a radial non-conducting path. In various embodiments, DC voltage sources 1370 and 1868 can be the same voltage source, and DC voltage sources 1371 and 1869 can be the same voltage sources.

Also note that FIG. 17 one voltage source is used to create a voltage difference across the inner trapezoidal electrodes, and in FIG. 18 two voltage sources are used to create a voltage difference across the inner trapezoidal electrodes. One skilled in the art can appreciate that these are two alternative embodiments.

Method for Compensating for the Lorentz Force

Figure 19:
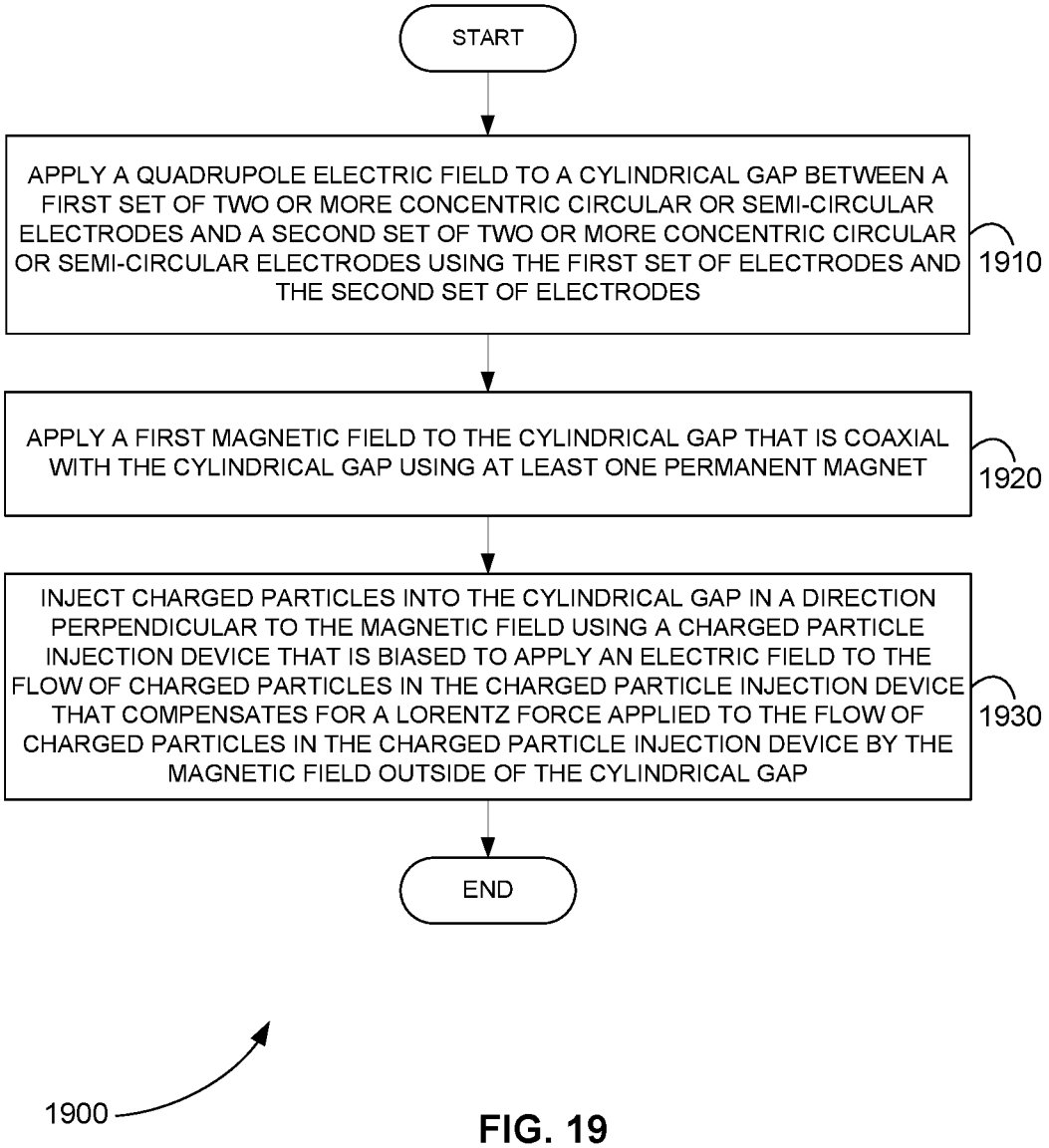
FIG. 19 is a flowchart showing a method for compensating for a Lorentz force experienced by charged particles flowing through a charged particle injection device used to inject the charged particles into a side-on injection Penning trap.

FIG. 19 is a flowchart showing a method 1900 for compensating for a Lorentz force experienced by charged particles flowing through a charged particle injection device used to inject the charged particles into a side-on injection Penning trap.

In step 1910 of method 1900, a quadrupole electric field is applied to a cylindrical gap between a first set of two or more concentric circular or semi-circular electrodes and a second set of two or more concentric circular or semi-circular electrodes that correspond in shape and size to the first set of electrodes using the first set of electrodes and the second set of electrodes. The first set of electrodes is printed on a first PCB and the second set of electrodes is printed on a second PCB. The second PCB is placed in parallel with the first PCB so that the second set of electrodes faces and is coaxial with the first set of electrodes. The space between the first set of electrodes and the second set of electrodes is the cylindrical gap used to trap charged particles.

In step 1920, a magnetic field is applied to the cylindrical gap that is coaxial with the cylindrical gap using at least one permanent magnet. The at least one permanent magnet is placed coaxially with the first set of electrodes and the second set of electrodes but outside of the cylindrical gap. The effects of the magnetic field and the quadrupole electric field combine to trap charged particles in the cylindrical gap that are injected in a direction perpendicular to the magnetic field.

In step 1930, charged particles are injected into the cylindrical gap in a direction perpendicular to the magnetic field using a charged particle injection device. The charged particle injection device is biased to apply an electric field to the flow of charged particles in the charged particle injection device that compensates for a Lorentz force applied to the flow of charged particles in the charged particle injection device by the magnetic field outside of the cylindrical gap.

Increasing m/z Range

As described above, an important feature of the side-on Penning trap is that the path length of the ions is not dependent on m/z value or injection kinetic energy. The fact that the path length of the ions is not dependent on m/z value or injection kinetic energy means that a side-on FT-ICR system can potentially analyze a collection of ions with a large range of m/z values at the same time. The primary problem is getting the ions with a large range of m/z values into the side-on Penning trap. As a result, systems and methods are needed to inject a collection of ions with a large range of m/z values into the side-on Penning trap at the same time.

In various embodiments, the range of m/z values injected into a side-on injection Penning trap is increased by pre-trapping ions just before injection of the ions into the side-on injection Penning trap. A pre-trap device is used to collect ions across a wide mass-to-charge ratio (m/z) range and inject the collected ions at the same time into the Penning trap in order to increase the m/z range of the ions that is analyzed.

System for Pre-trapping Ions to Increase m/z Range

Figure 20:
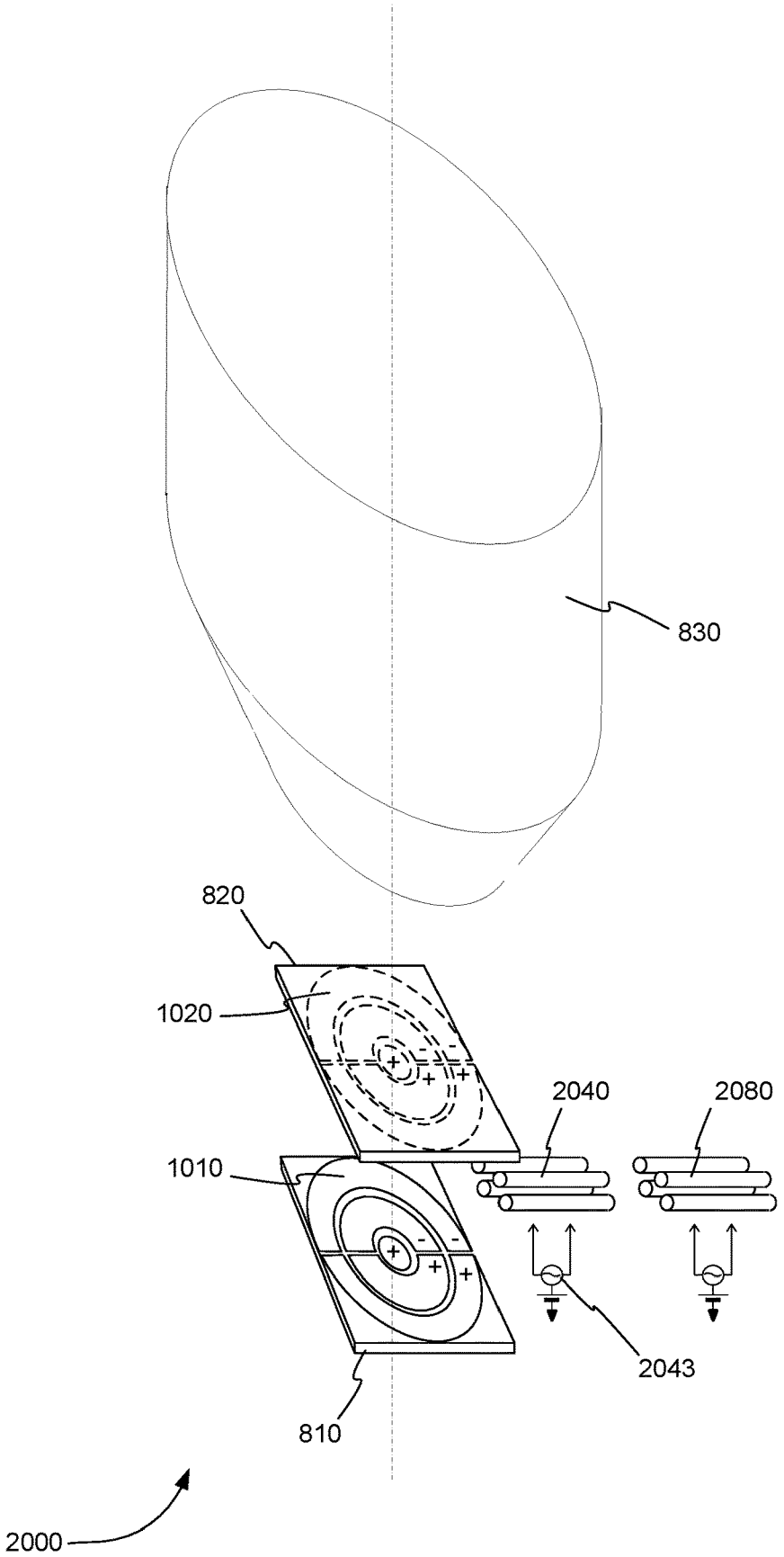
FIG. 20 is an exploded, oblique, and three-dimensional view of a side-on injection Penning trap that includes a pre-trap device that is used to collect ions across a wide m/z range and inject the collected ions at the same time into the Penning trap in order to increase the m/z range of the ions that is analyzed, in accordance with various embodiments.

FIG. 20 is an exploded, oblique, and three-dimensional view 2000 of a side-on injection Penning trap that includes a pre-trap device that is used to collect ions across a wide m/z range and inject the collected ions at the same time into the Penning trap in order to increase the m/z range of the ions that is analyzed, in accordance with various embodiments. The side-on injection Penning trap includes a first PCB 810 on which is printed a first set of two or more concentric circular or semi-circular electrodes 1010. The side-on injection Penning trap also includes a second PCB 820 on which is printed a second set of two or more concentric circular or semi-circular electrodes 1020. Second set of electrodes 1020 correspond in shape and size to first set of electrodes 1010.

Second PCB 820 is placed in parallel with first PCB 810 so that second set of electrodes 1020 faces and is coaxial with first set of electrodes 1010. The space between first set of electrodes 1010 and second set of electrodes 1020 is a cylindrical gap used to trap ions. First set of electrodes 1010 and second set of electrodes 1020 apply a quadrupole electric field to the cylindrical gap.

At least one permanent magnet 830 is placed coaxially with first set of electrodes 1010 and second set of electrodes 1020 but outside of the cylindrical gap. At least one permanent magnet 830 applies a magnetic field to the cylindrical gap that is coaxial with the cylindrical gap. The effects of the magnetic field and the quadrupole electric field combine to trap ions in the cylindrical gap with a drift frequency that is independent of the m/z value of the ions.

Pre-trap device 2040 is configured to collect ions across a mass-to-charge ratio (m/z) range. Pre-trap device 2040 is also configured to inject the collected ions pulse-wise at the same time into the cylindrical gap in a direction perpendicular to the magnetic field to increase the m/z range of the ions that are analyzed in the cylindrical gap.

In various embodiments, pre-trap device 2040 is a solid rod RF quadrupole linear ion trap, as shown in FIG. 20. For positively charged ions, in order to pre-trap ions in pre-trap device 2040, pre-trap device 2040 is biased with a voltage that is lower than first set of electrodes 1010 and second set of electrodes 1020. Pre-trap device 2040 is also biased with a voltage that is lower than ion guide 2080. Pre-trap device 2040 receives ions from ion guide 2080, for example. Ion guide 2080 is not part of side-on injection Penning trap. For negatively charged ions, the voltages are reversed.

For positively charged ions, in order to inject ions into the side-on injection Penning trap, pre-trap device 2040 is biased with a voltage that is higher than first set of electrodes 1010 and second set of electrodes 1020. Pre-trap device 2040 is also biased with a voltage that is higher than ion guide 2080 while injecting ions. For negatively charged ions, the voltages are reversed.

Figure 21:
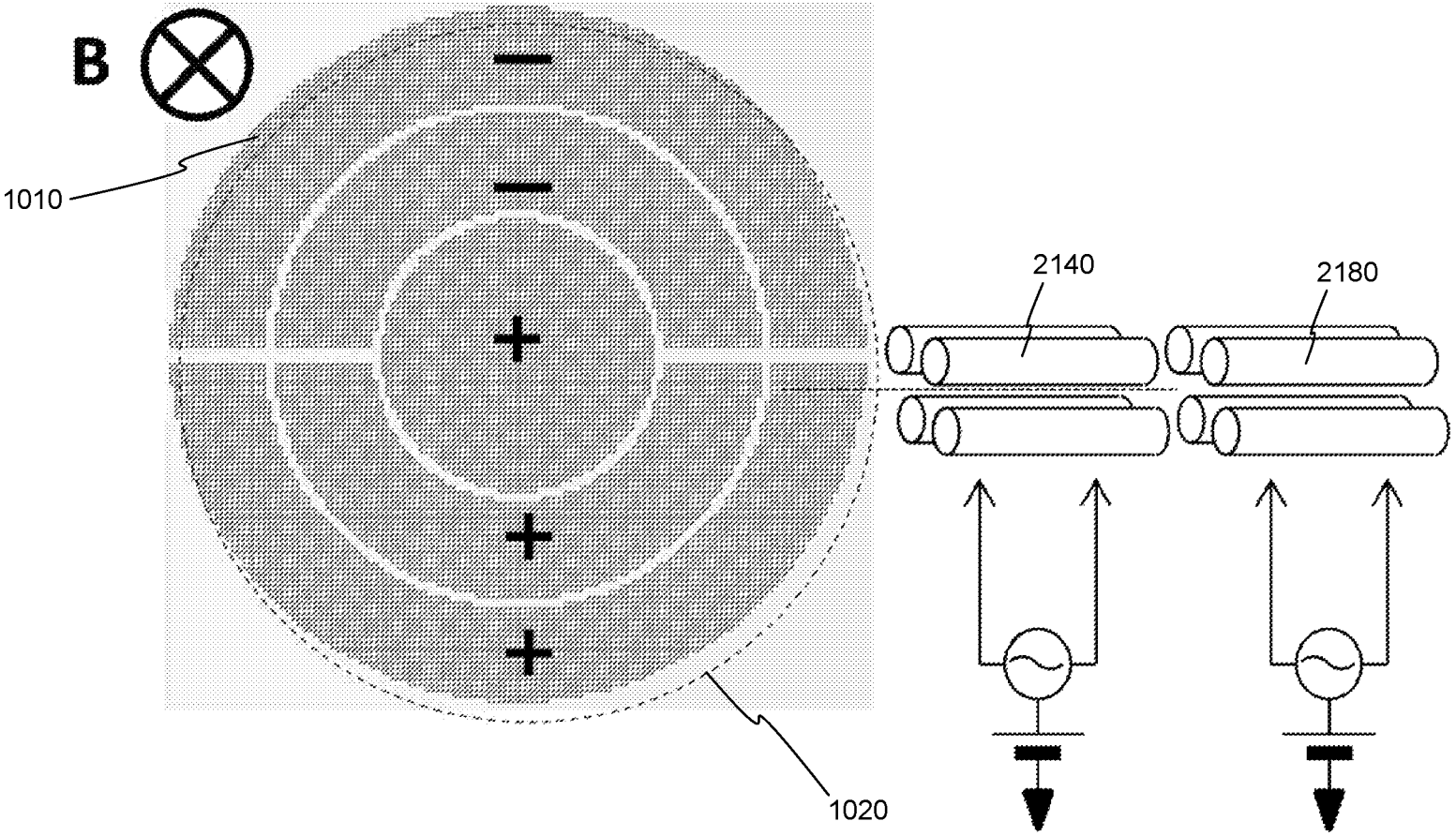
FIG. 21 is a top view of a the side-on injection Penning trap that includes a solid rod RF quadrupole linear ion trap pre-trap device that is used to collect ions across a wide m/z range and inject the collected ions at the same time into the Penning trap in order to increase the m/z range of the ions that is analyzed, in accordance with various embodiments.

FIG. 21 is a top view 2100 of a the side-on injection Penning trap that includes a solid rod RF quadrupole linear ion trap pre-trap device that is used to collect ions across a wide m/z range and inject the collected ions at the same time into the Penning trap in order to increase the m/z range of the ions that is analyzed, in accordance with various embodiments. Linear ion trap 2140 receives ions from ion guide 2180 over time to increase the m/z range of the ions trapped in linear ion trap 2140. Linear ion trap 2140 then injects the pre-trapped ions at the same time in the cylindrical gap between first set of electrodes 1010 and second set of electrodes 1020 of the side-on injection Penning trap so that an entire m/z range is analyzed.

Figure 22:
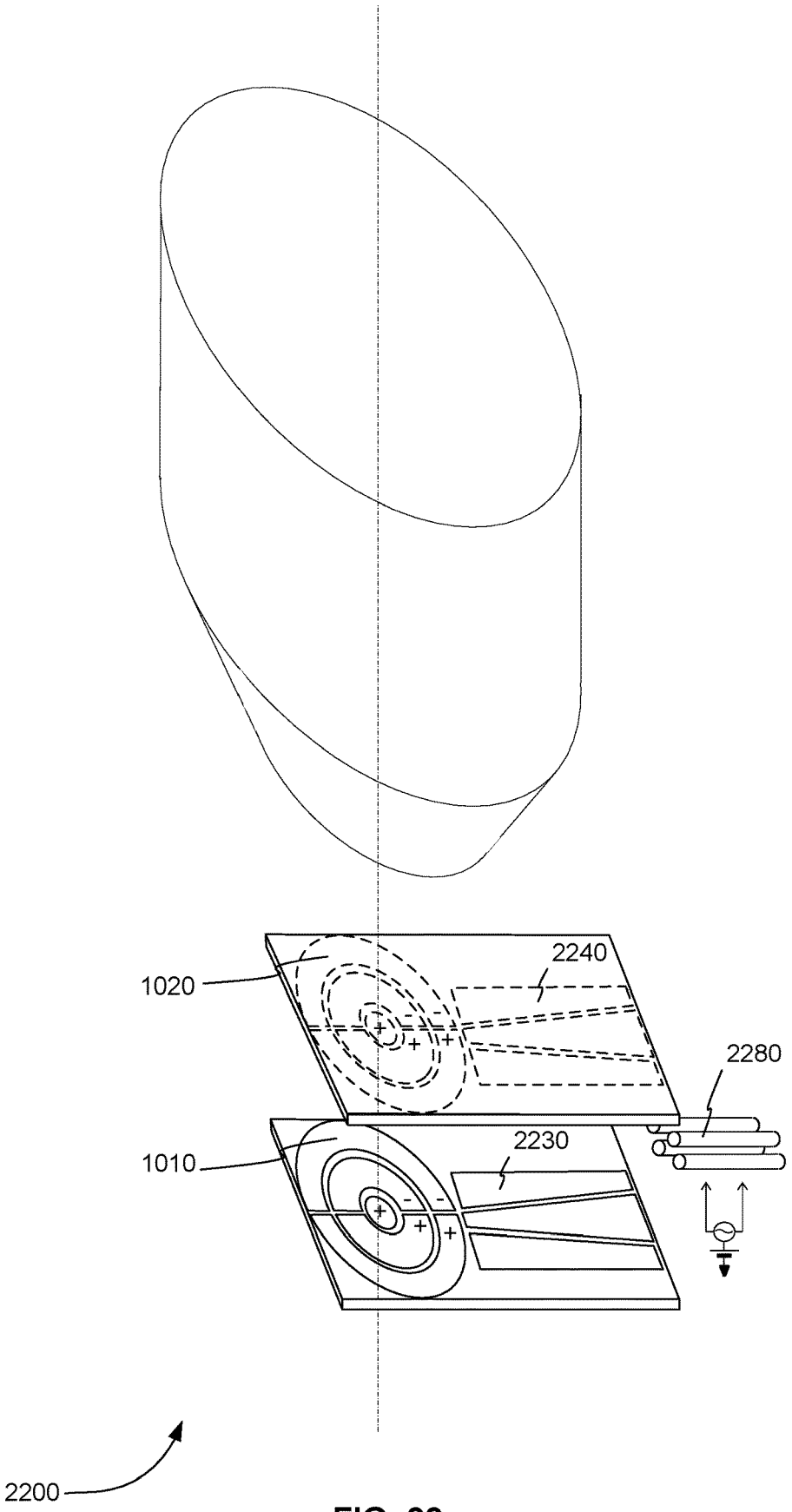
FIG. 22 is an exploded, oblique, and three-dimensional view of the side-on injection Penning trap of FIG. 10 showing how the trapezoidal electrodes printed on the PCBs of the side-on injection Penning trap are used as a pre-trap device, in accordance with various embodiments.

FIG. 22 is an exploded, oblique, and three-dimensional view 2200 of the side-on injection Penning trap of FIG. 10 showing how the trapezoidal electrodes printed on the PCBs of the side-on injection Penning trap are used as a pre-trap device, in accordance with various embodiments. For example, for positive ions, third set of three trapezoidal electrodes 2230 and fourth set of three trapezoidal electrodes 2240 are biased with a lower voltage than first set of electrodes 1010 and second set of electrodes 1020 to pre-trap ions across a mass-to-charge ratio (m/z) range. Third set of electrodes 2230 and fourth set of electrodes 2240 are also biased with a lower voltage that ion guide 2280 to receive ions from ion guide 2280. For negatively charged ions, the voltages are reversed.

After a predetermined time period third set of electrodes 2230 and fourth set of electrodes 2240 are biased with a higher voltage than first set of electrodes 1010 and second set of electrodes 1020 to inject the pre-trapped positive ions pulse-wise at the same time into the cylindrical gap between first set of electrodes 1010 and second set of electrodes 1020 to increase the m/z range of the ions that are analyzed in the cylindrical gap. During injection third set of electrodes 2230 and fourth set of electrodes 2240 are also biased with a higher voltage and with a higher voltage than ion guide 2280. For negatively charged ions, the voltages are reversed.

In various embodiments, for positive ions, after the predetermined time period, the central electrode of third set of electrodes 2230 and fourth set of electrodes 2240 is biased with a higher voltage that the two outer electrodes of third set of electrodes 2230 and fourth set of electrodes 2240 to also inject the pre-trapped ions pulse-wise at the same time into the cylindrical gap. For negatively charged ions, the voltages are reversed.

Figure 23:
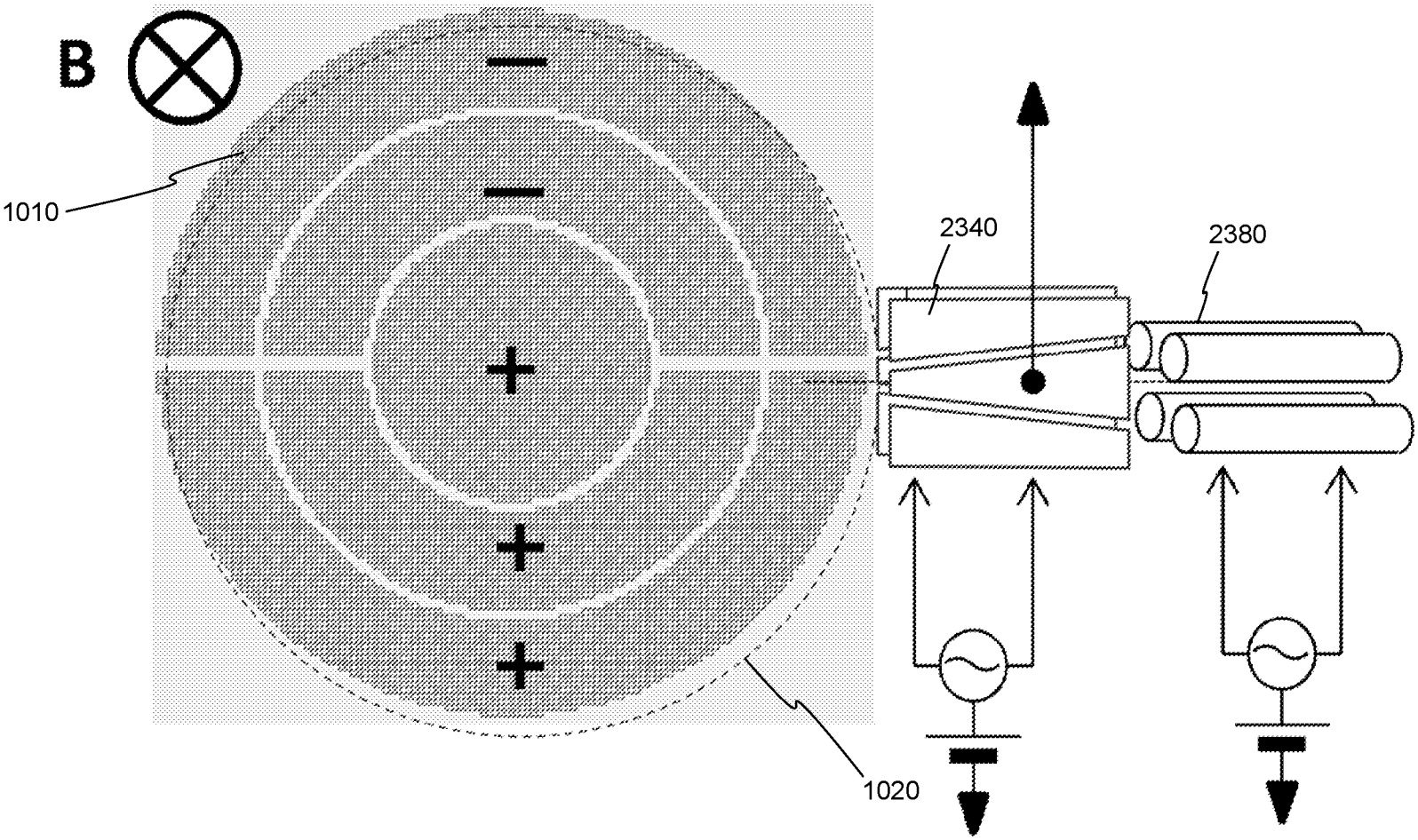
FIG. 23 is a top view of the side-on injection Penning trap of FIG. 11 showing how the trapezoidal electrodes printed on the PCBs of the side-on injection Penning trap are used as a pre-trap device, in accordance with various embodiments.

FIG. 23 is a top view 2300 of the side-on injection Penning trap of FIG. 11 showing how the trapezoidal electrodes printed on the PCBs of the side-on injection Penning trap are used as a pre-trap device, in accordance with various embodiments. Trapezoidal electrodes of pre-trap device 2340 receive ions from ion guide 2380 over time to increase the m/z range of the ions trapped pre-trap device 2340. Pre-trap device 2340 then injects the pre-trapped ions at the same time in the cylindrical gap between first set of electrodes 1010 and second set of electrodes 1020 of the side-on injection Penning trap so that an entire m/z range is analyzed.

Figure 24:
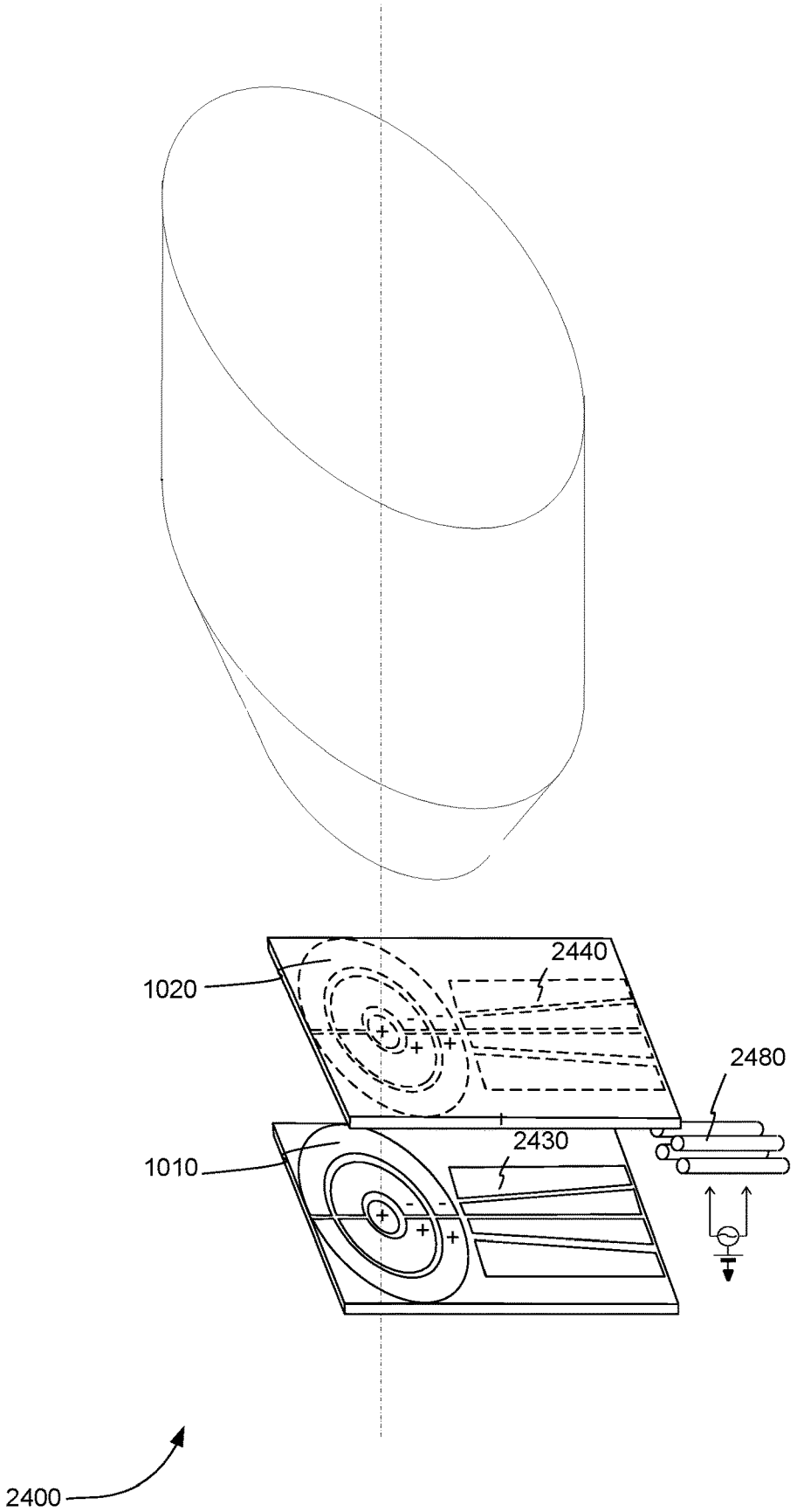
FIG. 24 is an exploded, oblique, and three-dimensional view of the side-on injection Penning trap of FIG. 12 showing how the trapezoidal electrodes printed on the PCBs of the side-on injection Penning trap are used as a pre-trap device, in accordance with various embodiments.

FIG. 24 is an exploded, oblique, and three-dimensional view 2400 of the side-on injection Penning trap of FIG. 12 showing how the trapezoidal electrodes printed on the PCBs of the side-on injection Penning trap are used as a pre-trap device, in accordance with various embodiments. For example, for positive ions, third set of four trapezoidal electrodes 2430 and fourth set of four trapezoidal electrodes 2440 are biased with a lower voltage than first set of electrodes 1010 and second set of electrodes 1020 to pre-trap ions across a mass-to-charge ratio (m/z) range. Third set of electrodes 2430 and fourth set of electrodes 2440 are also biased with a lower voltage that ion guide 2480 to receive ions from ion guide 2480. For negatively charged ions, the voltages are reversed.

After a predetermined time period third set of electrodes 2430 and fourth set of electrodes 2440 are biased with a higher voltage than first set of electrodes 1010 and second set of electrodes 1020 to inject the pre-trapped positive ions pulse-wise at the same time into the cylindrical gap between first set of electrodes 1010 and second set of electrodes 1020 to increase the m/z range of the ions that are analyzed in the cylindrical gap. During injection third set of electrodes 2430 and fourth set of electrodes 2440 are also biased with a higher voltage and with a higher voltage than ion guide 2480. For negatively charged ions, the voltages are reversed.

In various embodiments, for positive ions, after the predetermined time period, the two central electrode of third set of electrodes 2430 and fourth set of electrodes 2440 are biased with a higher voltage that the two outer electrodes of third set of electrodes 2430 and fourth set of electrodes 2440 to also inject the pre-trapped ions pulse-wise at the same time into the cylindrical gap. For negatively charged ions, the voltages are reversed.

Figure 25:
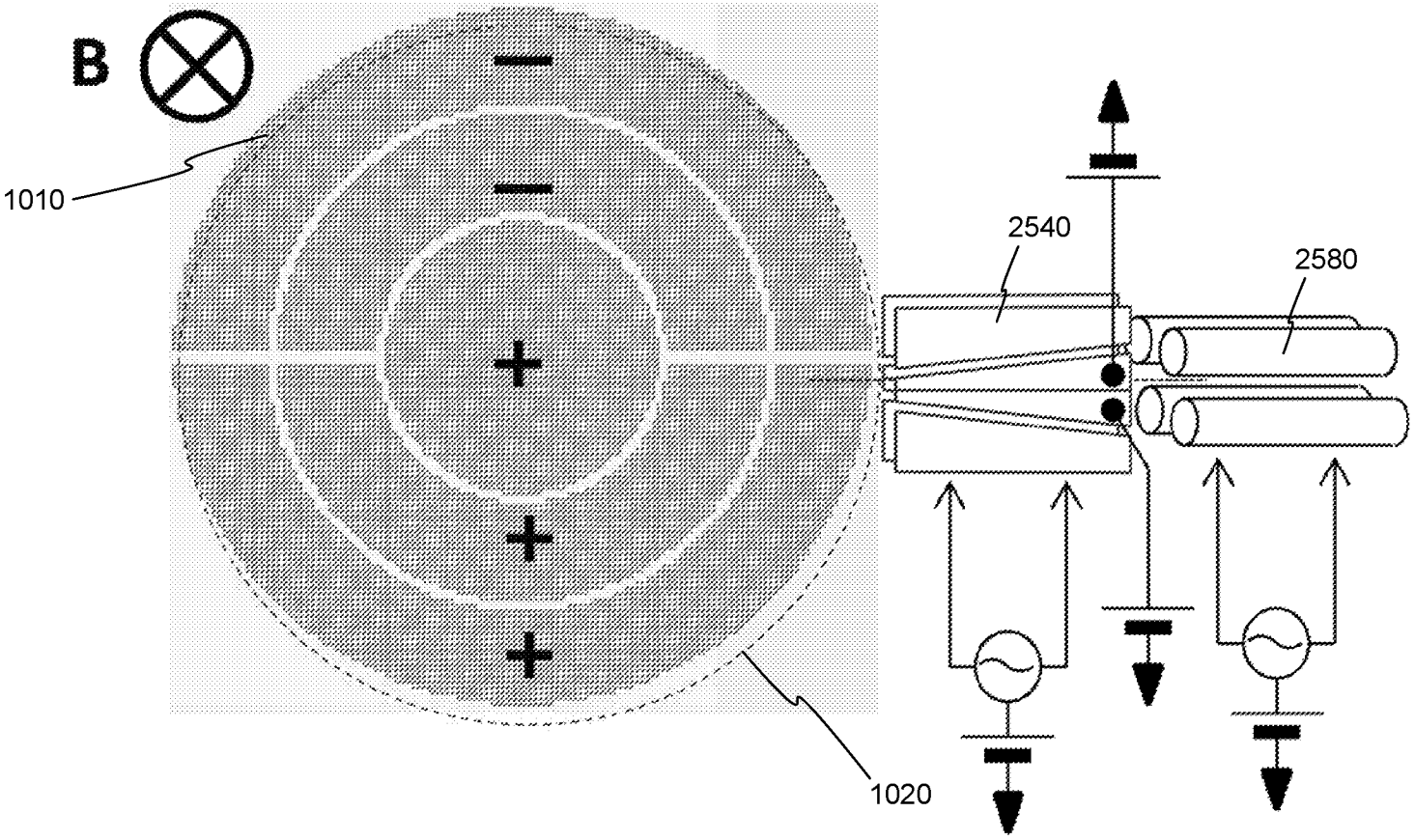
FIG. 25 is a top view of the side-on injection Penning trap of FIG. 13 showing how the trapezoidal electrodes printed on the PCBs of the side-on injection Penning trap are used as a pre-trap device, in accordance with various embodiments.

FIG. 25 is a top view 2500 of the side-on injection Penning trap of FIG. 13 showing how the trapezoidal electrodes printed on the PCBs of the side-on injection Penning trap are used as a pre-trap device, in accordance with various embodiments. Trapezoidal electrodes of pre-trap device 2540 receive ions from ion guide 2580 over time to increase the m/z range of the ions trapped pre-trap device 2540. Pre-trap device 2540 then injects the pre-trapped ions at the same time in the cylindrical gap between first set of electrodes 1010 and second set of electrodes 1020 of the side-on injection Penning trap so that an entire m/z range is analyzed.

Method for Pre-trapping Ions to Increase m/z Range

Figure 26:
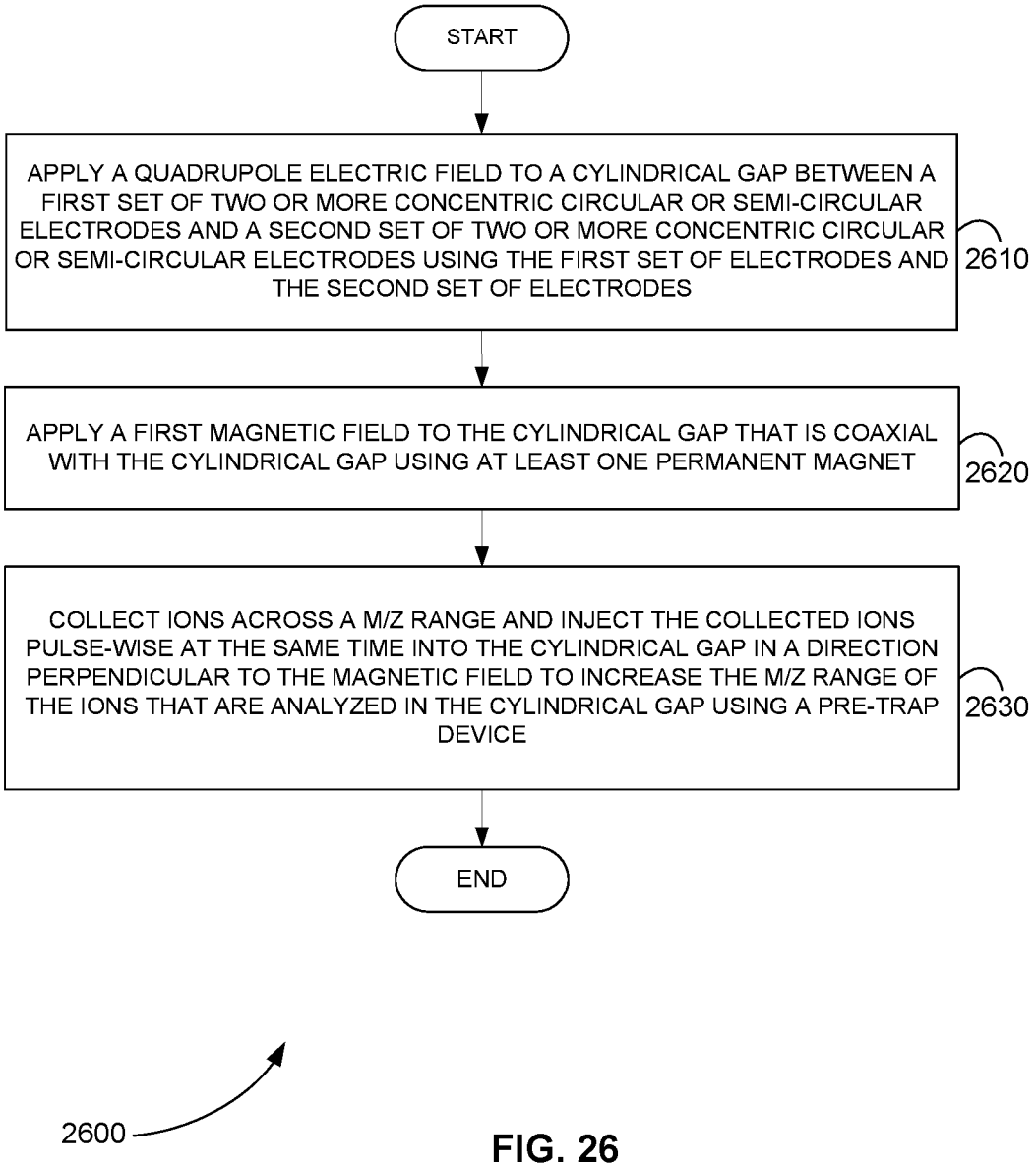
FIG. 26 is a flowchart showing a method for collecting ions across a m/z range and injecting the collected ions at the same time into a side-on Penning trap in order to increase the m/z range of the ions that is analyzed using a pre-trap device, in accordance with various embodiments.

FIG. 26 is a flowchart showing a method 2600 for collecting ions across a m/z range and injecting the collected ions at the same time into a side-on Penning trap in order to increase the m/z range of the ions that is analyzed using a pre-trap device, in accordance with various embodiments.

In step 2610 of method 2600, a quadrupole electric field is applied to a cylindrical gap between a first set of two or more concentric circular or semi-circular electrodes and a second set of two or more concentric circular or semi-circular electrodes that correspond in shape and size to the first set of electrodes using the first set of electrodes and the second set of electrodes. The first set of electrodes is printed on a first PCB and the second set of electrodes is printed on a second PCB. The second PCB is placed in parallel with the first PCB so that the second set of electrodes faces and is coaxial with the first set of electrodes. The space between the first set of electrodes and the second set of electrodes is the cylindrical gap used to trap ions.

In step 2620, a magnetic field is applied to the cylindrical gap that is coaxial with the cylindrical gap using at least one permanent magnet. The at least one permanent magnet is placed coaxially with the first set of electrodes and the second set of electrodes but outside of the cylindrical gap. The effects of the magnetic field and the quadrupole electric field combine to trap ions in the cylindrical gap that are injected in a direction perpendicular to the magnetic field with a drift frequency that is independent of the m/z value of the ions.

In step 2630, ions are collect across an m/z range and the collected ions are injected pulse-wise at the same time into the cylindrical gap in a direction perpendicular to the magnetic field to increase the m/z range of the ions that are analyzed in the cylindrical gap using a pre-trap device.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A side-on injection Penning trap that includes a charged particle injection device for injecting charged particles in a focusing region of an electric field, comprising:

a first printed circuit board (PCB) on which is printed a first set of electrodes, wherein the first set of electrodes includes a central disk electrode and one or more concentric segmented ring electrodes, wherein the central disk electrode and the next adjacent concentric segmented ring electrode are separated by a circular non-conducting path and each concentric segmented ring electrode is separated by the next adjacent concentric segmented ring electrode by a circular non-conducting path, and wherein each of the one or more concentric segmented ring electrodes is segmented by at least two radial non-conducting paths extending from the circular non-conducting path around the central disk electrode to the outer edge of the outermost segmented ring electrode, a second PCB on which is printed a second set of electrodes that corresponds in shape and size to the first set of electrodes, wherein the second PCB is placed in parallel with the first PCB so that the second set of electrodes and the first of electrodes are coaxial and so that each electrode and non-conducting path of the first set of electrodes faces a corresponding electrode and non-conducting path of the second set of electrodes, wherein the space between the first set of electrodes and the second set of electrodes is a cylindrical gap used to trap charged particles, and wherein the first set of electrodes and the second set of electrodes are biased to apply a quadrupole electric field to the cylindrical gap;

at least one permanent magnet that is placed coaxially with the first set of electrodes and the second set of electrodes but outside of the cylindrical gap that applies a magnetic field to the cylindrical gap that is coaxial with the cylindrical gap, wherein the effects of the magnetic field and the quadrupole electric field combine to trap charged particles in the cylindrical gap; and a charged particle injection device configured to inject charged particles into the cylindrical gap in a direction perpendicular to the magnetic field and parallel to a radial non-conducting path of the first set of electrodes and a corresponding radial non-conducting path of the second set of electrodes, wherein in injection mode, segments of the concentric segmented ring electrodes of the first set of electrodes on opposite sides of the radial non-conducting path are oppositely biased and segments of the concentric segmented ring electrodes of the second set of electrodes on opposite sides of the corresponding radial non-conducting path are correspondingly oppositely biased, producing an electric field in the cylindrical gap between the radial non-conducting path and the corresponding radial non-conducting path that has a focusing region and a defocusing region and wherein in injection mode, the charged particle injection device injects charged particles into the cylindrical gap along an axis of injection that is shifted from the axis of the radial non-conducting path and the axis of the corresponding radial non-conducting path towards segments of the concentric segmented ring electrodes of the first set of electrodes and towards segments of the corresponding concentric segmented ring electrodes of the second set of electrodes that are biased with the same polarity as the polarity of the charged particles so that the charged particles are injected in the focusing region.

2. The side-on injection Penning trap of claim 1, wherein the axis of the charged particle injection device is mechanically shifted perpendicular to the plane that includes the axis of the radial non-conducting path and the axis of the corresponding radial non-conducting path to inject charged particles into the cylindrical gap along an axis of injection that is shifted from the axis of the radial non-conducting path and the axis of the corresponding radial non-conducting path.

3. The side-on injection Penning trap of claim 2, wherein the charged particle injection device comprises a solid rod RF quadrupole ion guide.

4. The side-on injection Penning trap of claim 3, wherein the charged particles comprise positive ions and wherein the solid rod RF quadrupole ion guide is biased to act as a linear ion trap and pre-trap ions across a mass-to-charge ratio (m/z) range and inject the pre-trapped ions pulse-wise at the same time into the cylindrical gap in a direction perpendicular to the magnetic field to increase the m/z range of the ions that are analyzed in the cylindrical gap.

5. The side-on injection Penning trap of claim 2, wherein the charged particle injection device comprises a third set of three trapezoidal electrodes printed outside of the first set of electrodes on the first PCB and a fourth set of three trapezoidal electrodes printed outside of the second set of electrodes on the second PCB, wherein the third set of electrodes and the fourth set of electrodes each include a central trapezoidal electrode with two diagonal sides of equal length and with a width that tapers toward the first set of electrodes or the second set of electrodes and two outer trapezoidal electrodes on either side of the central trapezoidal electrode that each have a diagonal side adjacent to a diagonal side of the central trapezoidal electrode and a horizontal side opposite the diagonal side, that each have a width that tapers away from the first set of electrodes or the second set of electrodes, and that together with the central trapezoidal electrode form a rectangular shape, wherein the three trapezoidal electrodes of the third set of electrodes and the fourth set of electrodes correspond in shape and size, and corresponding electrodes of the third set of electrodes and the fourth set of electrodes face each other across an axial gap between the third set of electrodes and the fourth set of electrodes, wherein the two outer trapezoidal electrodes of the third set of electrodes and the fourth set of electrodes are biased with a radio frequency (RF) voltage to apply a quadrupole electric field to the axial gap and the central trapezoidal electrodes of the third set of electrodes and the fourth set of electrodes are biased with a direct current (DC) voltage to minimize effects of the dielectric material of the first PCB and the second PCB, and wherein the charged particle injection device is mechanically shifted by printing the third set of electrodes on the first PCB shifted from the axis of the radial non-conducting path and printing the fourth set of electrodes on the second PCB shifted from the axis of the corresponding radial non-conducting path.

6. The side-on injection Penning trap of claim 5, wherein a dipolar DC bias is applied across the two outer trapezoidal electrodes of both the third set of electrodes and the fourth set of electrodes to produce a dipolar electric field between the two outer trapezoidal electrodes of both the third set of electrodes and the fourth set of electrodes that is applied to the flow of charged particles in the charged particle injection device and that compensates for a Lorentz force applied to the flow of charged particles in the charged particle injection device by the magnetic field outside of the cylindrical gap.

7. The side-on injection Penning trap of claim 5, wherein the charged particles comprise positive ions and wherein the third set of electrodes and the fourth set of electrodes are biased with a lower voltage than the first set of electrodes and the second set of electrodes to pre-trap ions across a mass-to-charge ratio (m/z) range and then after a predetermined time period the third set of electrodes and the fourth set of electrodes are biased with a higher voltage than the first set of electrodes and the second set of electrodes to inject the pre-trapped ions pulse-wise at the same time into the cylindrical gap in a direction perpendicular to the magnetic field to increase the m/z range of the ions that are analyzed in the cylindrical gap.

8. The side-on injection Penning trap of claim 5, wherein after the predetermined time period, the central electrode of the third set of electrodes and the fourth set of electrodes is biased with a higher voltage that the two outer electrodes of the third set of electrodes and the fourth set of electrodes to also inject the pre-trapped ions pulse-wise at the same time into the cylindrical gap.

9. The side-on injection Penning trap of claim 1, wherein the axis of the charged particle injection device is located in the same plane as the axis of the radial non-conducting path and the axis of the corresponding radial non-conducting is electrically biased to inject charged particles into the cylindrical gap along an axis of injection that is shifted from the axis of the radial non-conducting path and the axis of the corresponding radial non-conducting.

10. The side-on injection Penning trap of claim 9, wherein the charged particle injection device comprises a third set of four trapezoidal electrodes printed outside of the first set of electrodes on the first PCB and a fourth set of four trapezoidal electrodes printed outside of the second set of electrodes on the second PCB, wherein the third set of electrodes and the fourth set of electrodes each include a two central trapezoidal electrodes that each have a horizontal side along the axis of the charged particle injection device and a diagonal side opposite the horizontal side, and a width that tapers toward the first set of electrodes or the second set of electrodes and two outer trapezoidal electrodes on either side of the two central trapezoidal electrodes that each have a diagonal side adjacent to a diagonal side of a central trapezoidal electrode and a horizontal side opposite the diagonal side, that each have a width that tapers away from the first set of electrodes or the second set of electrodes, and that together with the two central trapezoidal electrode form a rectangular shape, wherein the four trapezoidal electrodes of the third set of electrodes and the fourth set of electrodes correspond in shape and size, and corresponding electrodes of the third set of electrodes and the fourth set of electrodes face each other across an axial gap between the third set of electrodes and the fourth set of electrodes, wherein the two outer trapezoidal electrodes of the third set of electrodes and the fourth set of electrodes are biased with a radio frequency (RF) voltage to apply a quadrupole electric field to the axial gap and the two central trapezoidal electrodes of the third set of electrodes and the fourth set of electrodes are biased with a direct current (DC) voltage to minimize effects of the dielectric material of the first PCB and the second PCB, and wherein the third set of electrodes are printed on the first PCB to share the axis of the radial non-conducting path and the fourth set of electrodes are printed on the second PCB to share the axis of the corresponding radial non-conducting path and a DC voltage is applied across the two central electrodes of the third set of electrodes and the fourth set of electrodes to inject charged particles into the cylindrical gap along an axis of injection that is shifted from the axis of the radial non-conducting path and the axis of the corresponding radial non-conducting.

11. The side-on injection Penning trap of claim 10, wherein a dipolar DC bias is further applied across the two inner trapezoidal electrodes of both the third set of electrodes and the fourth set of electrodes to produce a dipolar electric field between the two inner trapezoidal electrodes of both the third set of electrodes and the fourth set of electrodes that is applied to the flow of charged particles in the charged particle injection device and that compensates for a Lorentz force applied to the flow of charged particles in the charged particle injection device by the magnetic field outside of the cylindrical gap.

12. The side-on injection Penning trap of claim 10, wherein the charged particles comprise positive ions and wherein the third set of electrodes and the fourth set of electrodes are biased with a lower voltage than the first set of electrodes and the second set of electrodes to pre-trap ions across a mass-to-charge ratio (m/z) range and then after a predetermined time period the third set of electrodes and the fourth set of electrodes are biased with a higher voltage than the first set of electrodes and the second set of electrodes to inject the pre-trapped ions pulse-wise at the same time into the cylindrical gap in a direction perpendicular to the magnetic field to increase the m/z range of the ions that are analyzed in the cylindrical gap.

13. The side-on injection Penning trap of claim 12, wherein after the predetermined time period, the two central electrodes of the third set of electrodes and the fourth set of electrodes are biased with a higher voltage that the two outer electrodes of the third set of electrodes and the fourth set of electrodes to also inject the pre-trapped ions pulse-wise at the same time into the cylindrical gap.

14. A method for injecting charged particles in a focusing region of an electric field in a side-on injection Penning trap, comprising:

applying a quadrupole electric field to a cylindrical gap between a first set of electrodes printed on a first printed circuit board (PCB) and a second set of electrodes that correspond in shape and size to the first set of electrodes printed on a second PCB using the first set of electrodes and second set of electrodes, wherein the first set of electrodes and the second set of electrodes each include a central disk electrode and one or more concentric segmented ring electrodes, the central disk electrode and the next adjacent concentric segmented ring electrode are separated by a circular non-conducting path and each concentric segmented ring electrode is separated by the next adjacent concentric segmented ring electrode by a circular non-conducting path, and each of the one or more concentric segmented ring electrodes is segmented by at least two radial non-conducting paths extending from the circular non-conducting path around the central disk electrode to the outer edge of the outermost segmented ring electrode, wherein the second PCB is placed in parallel with the first PCB so that the second set of electrodes and the first of electrodes are coaxial and so that each electrode and non-conducting path of the first set of electrodes faces a corresponding electrode and non-conducting path of the second set of electrodes, wherein the space between the first set of electrodes and the second set of electrodes is a cylindrical gap used to trap charged particles, and wherein the first set of electrodes and the second set of electrodes are biased to apply a quadrupole electric field to the cylindrical gap;

applying a magnetic field to the cylindrical gap that is coaxial with the cylindrical gap using at least one permanent magnet that is placed coaxially with the first set of electrodes and the second set of electrodes but outside of the cylindrical gap, wherein the effects of the magnetic field and the quadrupole electric field combine to trap charged particles in the cylindrical gap; and injecting charged particles into the cylindrical gap in a direction perpendicular to the magnetic field and parallel to a radial non-conducting path of the first set of electrodes and a corresponding radial non-conducting path of the second set of electrodes using a charged particle injection device, wherein in injection mode, segments of the concentric segmented ring electrodes of the first set of electrodes on opposite sides of the radial non-conducting path are oppositely biased and segments of the concentric segmented ring electrodes of the second set of electrodes on opposite sides of the corresponding radial non-conducting path are correspondingly oppositely biased, producing an electric field in the cylindrical gap between the radial non-conducting path and the corresponding radial non-conducting path that has a focusing region and a defocusing region and wherein in injection mode, the charged particle injection device injects charged particles into the cylindrical gap along an axis of injection that is shifted from the axis of the radial non-conducting path and the axis of the corresponding radial non-conducting path towards segments of the concentric segmented ring electrodes of the first set of electrodes and towards segments of the corresponding concentric segmented ring electrodes of the second set of electrodes that are biased with the same polarity as the polarity of the charged particles so that the charged particles are injected in the focusing region.

15. A side-on injection Penning trap that includes a charged particle injection device that is biased to compensate for a Lorentz force experienced by charged particles flowing through the charged particle injection device, comprising:

a first printed circuit board (PCB) on which is printed a first set of two or more concentric circular or semi-circular electrodes;

a second PCB on which is printed a second set of two or more concentric circular or semi-circular electrodes that correspond in shape and size to the first set of electrodes, wherein the second PCB is placed in parallel with the first PCB so that the second set of electrodes faces and is coaxial with the first set of electrodes, wherein the space between the first set of electrodes and the second set of electrodes is a cylindrical gap used to trap charged particles, and wherein the first set of electrodes and the second set of electrodes apply a quadrupole electric field to the cylindrical gap;

at least one permanent magnet that is placed coaxially with the first set of electrodes and the second set of electrodes but outside of the cylindrical gap that applies a magnetic field to the cylindrical gap that is coaxial with the cylindrical gap, wherein the effects of the first magnetic field and the quadrupole electric field combine to trap charged particles in the cylindrical gap; and a charged particle injection device configured to inject charged particles into the cylindrical gap in a direction perpendicular to the magnetic field and biased to apply an electric field to the flow of charged particles in the charged particle injection device that compensates for a Lorentz force applied to the flow of charged particles in the charged particle injection device by the magnetic field outside of the cylindrical gap, wherein the charged particle injection device comprises a third set of trapezoidal electrodes printed outside of the first set of electrodes on the first PCB, and a fourth set of trapezoidal electrodes printed outside of the second set of electrodes on the second PCB, wherein the third set of trapezoidal electrodes and the fourth set of trapezoidal electrodes are tapered radio frequency (RF) quadrupole electrode pads for providing a dipolar electric field to compensate for the Lorentz force applied to the flow of charged particles in the charged particle injection device by the magnetic field outside of the cylindrical gap.

16. The side-on injection Penning trap of claim 15, wherein the charged particle injection device comprises a third set of three trapezoidal electrodes printed outside of the first set of electrodes on the first PCB and a fourth set of three trapezoidal electrodes printed outside of the second set of electrodes on the second PCB, wherein the third set of electrodes and the fourth set of electrodes each include a central trapezoidal electrode with two diagonal sides of equal length and with a width that tapers toward the first set of electrodes or the second set of electrodes and two outer trapezoidal electrodes on either side of the central trapezoidal electrode that each have a diagonal side adjacent to a diagonal side of the central trapezoidal electrode and a horizontal side opposite the diagonal side, that each have a width that tapers away from the first set of electrodes or the second set of electrodes, and that together with the central trapezoidal electrode form a rectangular shape, wherein the three trapezoidal electrodes of the third set of electrodes and the fourth set of electrodes correspond in shape and size, and corresponding electrodes of the third set of electrodes and the fourth set of electrodes face each other across an axial gap between the third set of electrodes and the fourth set of electrodes, wherein the two outer trapezoidal electrodes of the third set of electrodes and the fourth set of electrodes are biased with a radio frequency (RF) voltage to apply a quadrupole electric field to the axial gap and the central trapezoidal electrodes of the third set of electrodes and the fourth set of electrodes are biased with a direct current (DC) voltage to minimize effects of the dielectric material of the first PCB and the second PCB, and wherein a dipolar DC bias is applied across the two outer trapezoidal electrodes of both the third set of electrodes and the fourth set of electrodes to produce a dipolar electric field between the two outer trapezoidal electrodes of both the third set of electrodes and the fourth set of electrodes that is applied to the flow of charged particles in the charged particle injection device and that compensates for the Lorentz force applied to the flow of charged particles in the charged particle injection device by the magnetic field outside of the cylindrical gap.

17. The side-on injection Penning trap of claim 15, wherein the charged particle injection device comprises a third set of four trapezoidal electrodes printed outside of the first set of electrodes on the first PCB and a fourth set of four trapezoidal electrodes printed outside of the second set of electrodes on the second PCB, wherein the third set of electrodes and the fourth set of electrodes each include a two central trapezoidal electrodes that each have a horizontal side along the axis of the charged particle injection device and a diagonal side opposite the horizontal side, and a width that tapers toward the first set of electrodes or the second set of electrodes and two outer trapezoidal electrodes on either side of the two central trapezoidal electrodes that each have a diagonal side adjacent to a diagonal side of a central trapezoidal electrode and a horizontal side opposite the diagonal side, that each have a width that tapers away from the first set of electrodes or the second set of electrodes, and that together with the two central trapezoidal electrode form a rectangular shape, wherein the four trapezoidal electrodes of the third set of electrodes and the fourth set of electrodes correspond in shape and size, and corresponding electrodes of the third set of electrodes and the fourth set of electrodes face each other across an axial gap between the third set of electrodes and the fourth set of electrodes, wherein the two outer trapezoidal electrodes of the third set of electrodes and the fourth set of electrodes are biased with a radio frequency (RF) voltage to apply a quadrupole electric field to the axial gap and the two central trapezoidal electrodes of the third set of electrodes and the fourth set of electrodes are biased with a direct current (DC) voltage to minimize effects of the dielectric material of the first PCB and the second PCB, and wherein a dipolar DC bias is applied across the two inner trapezoidal electrodes of both the third set of electrodes and the fourth set of electrodes to produce a dipolar electric field between the two inner trapezoidal electrodes of both the third set of electrodes and the fourth set of electrodes that is applied to the flow of charged particles in the charged particle injection device and that compensates for the Lorentz force applied to the flow of charged particles in the charged particle injection device by the magnetic field outside of the cylindrical gap.

* * * * *